US010240862B2

(12) United States Patent
Faka et al.

(10) Patent No.: US 10,240,862 B2
(45) Date of Patent: Mar. 26, 2019

(54) LNG PRODUCTION PLANT AND CORRESPONDING METHOD OF CONSTRUCTION

(71) Applicant: Woodside Energy Technologies Pty Ltd, Perth WA (AU)

(72) Inventors: Solomon Aladja Faka, Salter Point (AU); Geoffrey Brian Byfield, Nedlands (AU); Benjamin Dean Warwick, Walliston (AU)

(73) Assignee: WOODSIDE ENERGY TECHNOLOGIES PTY LTD, Perth (AU)

( * ) Notice: Subject to any disclaimer, the term of this patent is extended or adjusted under 35 U.S.C. 154(b) by 0 days.

(21) Appl. No.: 15/822,829

(22) Filed: Nov. 27, 2017

(65) Prior Publication Data

US 2018/0224204 A1 Aug. 9, 2018

Related U.S. Application Data

(63) Continuation of application No. PCT/AU2016/000125, filed on Apr. 11, 2016.

(30) Foreign Application Priority Data

May 28, 2015 (AU) ..... 2015901975

(51) Int. Cl.
*B63B 25/16* (2006.01)
*B63B 27/30* (2006.01)
(Continued)

(52) U.S. Cl.
CPC ..... *F25J 1/0278* (2013.01); *B63B 25/16* (2013.01); *B63B 27/30* (2013.01); *B63B 35/003* (2013.01);
(Continued)

(58) Field of Classification Search
CPC ..... F25J 1/0278; F25J 2290/72; B63B 27/30
See application file for complete search history.

(56) References Cited

U.S. PATENT DOCUMENTS 3,977,346 A * 8/1976 Natvig ..... B63B 9/065 114/65 R
4,086,777 A * 5/1978 Lai ..... B63B 9/065 114/258
(Continued)

FOREIGN PATENT DOCUMENTS

AU 2012207059 B2 8/2012
CA 2888026 A1 3/2015
(Continued)

OTHER PUBLICATIONS

CA Office Action, dated Apr. 13, 2017, 3 pages.
(Continued)

*Primary Examiner* — Benjamin F Fiorello
(74) *Attorney, Agent, or Firm* — Edell, Shapiro & Finnan, LLC

(57) ABSTRACT

An LNG production plant and a method of constructing the LNG production plant is disclosed. The LNG production plant includes at least one plant module and a support structure to support the plant module. Each plant module is dry transported by a heavy lift vessel and subsequently transferred to the support structure without lifting the plant module from a deck of the vessel. The support structure includes a landing substructure onto which the plant module is transferred from the vessel. Landing substructure may be onshore or offshore. The support structure may also include one or more onshore support substructures and a transfer path enabling a plant module to be moved from the landing substructure to a corresponding onshore support substructure.

37 Claims, 19 Drawing Sheets

(51) Int. Cl.

| | |
|---|---|
| ***F25J 1/02*** | (2006.01) |
| ***B63B 35/00*** | (2006.01) |
| ***E02D 27/32*** | (2006.01) |
| ***F25J 1/00*** | (2006.01) |
| *E02B 17/00* | (2006.01) |
| *B63B 1/04* | (2006.01) |
| *B63B 35/44* | (2006.01) |

(52) U.S. Cl.

CPC ..... *E02D 27/32* (2013.01); *F25J 1/0022* (2013.01); *F25J 1/0216* (2013.01); *F25J 1/0228* (2013.01); *B63B 35/44* (2013.01); *B63B 2001/044* (2013.01); *B63B 2035/4486* (2013.01); *B63B 2207/00* (2013.01); *E02B 17/00* (2013.01); *F25J 2290/42* (2013.01); *F25J 2290/62* (2013.01); *F25J 2290/70* (2013.01); *F25J 2290/72* (2013.01)

(56) References Cited

U.S. PATENT DOCUMENTS

| | | | | |
|---|---|---|---|---|
| 4,188,157 | A | 2/1980 | Vigander | |
| 4,690,586 | A * | 9/1987 | Oksuzler | B63B 35/003 405/203 |
| 4,729,695 | A * | 3/1988 | Silvestri | E02B 17/00 405/204 |
| 4,930,938 | A | 6/1990 | Rawstron et al. | |
| 5,388,930 | A * | 2/1995 | McNease | B63B 27/02 405/196 |
| 5,403,124 | A * | 4/1995 | Kocaman | B63B 35/003 405/204 |
| 5,924,822 | A | 7/1999 | Finn et al. | |
| 6,347,909 | B1 | 2/2002 | Kocaman | |
| 8,251,004 | B2 * | 8/2012 | Olsen | B63B 35/003 114/258 |
| 8,534,213 | B2 * | 9/2013 | Chitwood | B63B 35/40 114/258 |
| 8,899,880 | B2 * | 12/2014 | Foo | E02B 17/0021 405/196 |
| 2013/0071207 | A1 | 3/2013 | Luo et al. | |

FOREIGN PATENT DOCUMENTS

| | | | |
|---|---|---|---|
| CN | 201999177 | U | 10/2011 |
| GB | 2003798 | A | 3/1979 |
| WO | 2015039169 | A1 | 3/2015 |

OTHER PUBLICATIONS

AU Patent Examination Report No. 1, dated Sep. 21, 2015, 5 pages.
PCT International Preliminary Report, PCT/AU2016/000125, dated Mar. 27, 2017, 6 pages.
PCT International Search Report, PCT/AU2016/000125, dated Dec. 1, 2016, 3 pages.

* cited by examiner

LNG PRODUCTION PLANT AND CORRESPONDING METHOD OF CONSTRUCTION

TECHNICAL FIELD

A liquefied natural gas (LNG) production plant and a corresponding method of construction are disclosed.

BACKGROUND ART

LNG production plants are large complex and expensive plants to construct and maintain. Traditional stick-built onshore LNG plants have almost become uneconomic due to the costs involved with acquisition of suitable land, dredging, jetty construction, and labour. Processes involved in the production of LNG such as gas pre-treatment, liquefaction and storage are typically undertaken at a fixed onshore LNG production plant associated with a jetty that is built in sufficiently deep water to allow berthing of the LNG Carriers. it is common practice for the onshore LNG production plant to be entirely constructed on site using a method of construction referred to in the art as "stick-built". Efforts to reduce this cost have largely been focused on seeking to leverage the economics of scale via increased LNG train capacity size and improvements in LNG Carrier berth utilization.

To avoid the environmental impacts associated with the coastal modifications that often forms part of traditional onshore LNG plants, it has been proposed to produce LNG at sea at an offshore location. In one example of this, the entire LNG production is proposed to be performed on a floating LNG production ("FLNG") vessel. Given their size and complexity, the costs associated with the implementation of a complete LNG liquefaction plant onboard a FLNG vessel at sea are extremely high. The limited space onboard a FLNG vessel requires that the LNG production facility must be designed to fit within the compact footprint of a barge or vessel and is restricted to a particular fixed feed processing rate, as all available deck space is utilised and optimised to keep the overall size of the floating LNG production vessel to a minimum.

This results in an increased risk being carried compared to onshore plants. The layout issues are further complicated by some of the equipment being sensitive to motion during different sea states, logistics difficulties associated with maintenance, and restricted LNG carrier mooring conditions. There are also large loads placed on plant equipment on such barges as a consequence of wave motion or the impact of waves upon these floating structures which can cause shutdowns during severe weather conditions. Such floating structures can avoid severe weather conditions by shutting down, being disconnected and sailing away which leads to disruption in production and lengthy start up times.

There remains a need for an alternative LNG processing plant that may address one or more of the above-described disadvantages of conventional LNG processing plants.

The above reference to the background art does not constitute an admission that the art forms a part of the common general knowledge of the person of ordinary skill in the art. The above references are also not intended to limit the application of the method and plant as disclosed herein.

SUMMARY OF THE INVENTION

In one aspect there is disclosed a method of constructing a LNG production plant comprising the steps of:

dry transporting on a heavy lift vessel a plant module across a body of water;

transferring from the heavy lift vessel the plant module onto a structure arranged to support the plant module at a fixed altitude, wherein the transferring is performed without lifting the module; and arranging the plant module as, or as a part of, the LNG production plant to facilitate the production and/or storage of LNG.

In one embodiment the transferring comprises for at least a period of time supporting the plant module simultaneously on both the structure and a deck of the heavy lift vessel.

In one embodiment the transferring comprises adjusting buoyance of the vessel so that each of one or more contact surfaces of the plant module lie at an altitude substantially flush with an altitude of a support surface of the structure.

In one embodiment the transferring comprises: floating over of the plant module by the heavy lift vessel directly onto the structure; skidding the module off the heavy lift vessel; driving the plant module off the heavy lift vessel, pushing the plant module off the vessel or pulling the plant module off the heavy lift vessel.

In one embodiment the transferring comprises a combination of: floating over the plant module by the heavy lift vessel and subsequently skidding the plant module across the structure; or, floating over the plant module by the heavy lift vessel onto the structure and subsequently driving the plant module across the structure.

In one embodiment the method comprises installing the structure near a shoreline defining a boundary between an onshore location and an offshore location in the body of water adjacent to the onshore location.

In one embodiment installing the structure comprises installing the structure at a location so that the plant module resides wholly over the offshore location.

In an alternate embodiment installing the structure comprises installing the structure at a location. so that the plant module resides at a location that spans the shore line.

In an alternate embodiment installing the structure comprises installing the structure at a location so that the plant module resides wholly over the onshore location.

In one embodiment installing the structure comprises installing the structure as a ground founded. landing substructure onto which the plant module is transferred from the heavy lift vessel.

In one embodiment installing the structure comprises installing one or more onshore support substructures and constructing a transport path between the landing substructure and one or more onshore support substructures.

In one embodiment the method comprises moving the plant module across or along the transfer path from the landing substructure to the one or more onshore support substructures.

In one embodiment moving the LNG structure comprises at least one of: skidding, pulling, pushing or driving the plant module across or along the transport path.

In one embodiment constructing the transport path comprise laying one or more rails, tracks or roads.

In one embodiment the method comprises configuring the transport path to have at least one change in direction or to facilitate a change in direction of motion of a plant module from the landing structure to an onshore support substructure.

In one embodiment constructing the transport path comprises installing a turntable capable of receiving a plant module being moved in one direction and rotating die plant module to enable further movement of the plant module in a second different direction.

In one embodiment the method comprises constructing the plant module as one of:

- a superstructure on or in which plant and equipment for performing or supporting a process step in the production of LNG can be mounted or installed the superstructure being dimensioned to facilitate transfer from the heavy lift vessel to the support structure;
- a complete LNG train which includes: a superstructure dimensioned to facilitate transfer from a heavy lift vessel to the support structure and plant and equipment mounted on a deck of the superstructure required for the pre-treatment of a LNG feed stream and subsequent liquefaction to produce LNG;
- a pre-treatment module which includes the superstructure dimensioned to facilitate transfer from a heavy lift vessel to the support structure and plant and equipment mounted on the deck of a superstructure to produce a pre-treated natural gas stream;
- a first refrigerant compression module which includes a superstructure dimensioned to facilitate transfer from a heavy lift vessel to the support structure and plant and equipment mounted on a deck of the superstructure to provide compression of a refrigerant;
- a first refrigerant condenser module which includes a superstructure dimensioned to facilitate transfer from a heavy lift vessel to the support structure and plant and equipment mounted on a deck of the superstructure to condense a refrigerant;
- a liquefaction facility which includes a superstructure dimensioned to facilitate transfer from a heavy lift vessel to the support structure and plant and equipment mounted on a deck of the superstructure to liquefy a vapour;
- a second refrigerant compression module which includes a superstructure and plant and equipment on the superstructure to perform compression of a second refrigerant, for example the second refrigerant compression module may be a mixed refrigerant (MR) compression module;
- a utilities module which includes plant, facilities or equipment for one or a combination of two or more of: power generation, condensate stabilisation, MEG regeneration, drinking and service water and firefighting; or
- storage tanks for holding LNG or other fluids wherein the tanks comprise or are disposed in a superstructure dimensioned to facilitate transfer from a heavy lift vessel to the support structure.

In one embodiment the dry transporting is performed on two or more occasions to transport two or more plant modules to the structure.

In one embodiment the method comprises: transporting as a plant module at least one complete LNG train or at least one LNG liquefaction facility to a LNG production plant location; and transporting at least one LNG storage facility to the production plant location; and wherein constructing the LNG production plant further comprises connecting the at least one LNG train or LNG liquefaction facility to the LNG storage facility. In this embodiment the LNG storage facility nay be in the form of a plant module, which is transported by a heavy lift vessel and transferred onto a support structure. However in an alternate form of this embodiment the LNG storage facility may be provided in the form of a gravity-based structure or a floating structure, which is dry towed or wet towed to the LNG production plant location.

In a second aspect there is disclosed a LNG production plant comprising:

one or more a dry transportable plant modules;

a support structure having a fixed altitude and configured to receive the one or more plant modules transferred from a heavy lift vessel without one or more the plant modules being lifted from a deck of the heavy lift vessel, the support structure further arranged to support the one or more plant modules when the one or more plant modules constitute, or are coupled together to form, the LNG production plant.

In one embodiment the support structure is configured so that a plant module being transferred from the heavy lift vessel to the support structure is able to be supported by both the support structure and a deck of the vessel simultaneously for a period of time during the transfer.

In one embodiment the one or more plant modules comprise one or more of:

- a superstructure on or in which plant and equipment for performing or supporting a process step in the production of LNG can be mounted or installed, the superstructure being dimensioned to facilitate transfer from the heavy lift vessel to the support structure;
- a complete LNG train which includes: a superstructure dimensioned to facilitate transfer from a heavy lift vessel to the support structure and plant and equipment mounted on a deck of the superstructure required for the pre-treatment of a LNG feed stream and subsequent liquefaction to produce LNG;
- a pre-treatment module which includes the superstructure dimensioned to facilitate transfer from a heavy lift vessel to the support structure and plant and equipment mounted on the deck of a superstructure to produce a pre-treated natural gas stream;
- a first refrigerant compression module which includes a superstructure dimensioned to facilitate transfer from a heavy lift vessel to the support structure and plant and equipment mounted on a deck of the superstructure to provide compression of a refrigerant;
- a first refrigerant condenser module which includes a superstructure dimensioned to facilitate transfer from a heavy lift vessel to the support structure and plant and equipment mounted on a deck of the superstructure to condense a refrigerant;
- a liquefaction facility which includes a superstructure dimensioned to facilitate transfer from a heavy lift vessel to the support structure and plant and equipment mounted on a deck of the superstructure to liquefy a vapour;
- a second refrigerant compression module which includes a superstructure and plant and equipment on the superstructure to perform compression of a second refrigerant, for example the second refrigerant compression module may be a mixed refrigerant (MR) compression module;
- a utilities module which includes plant, facilities or equipment for one or a combination of two or more of: power generation, condensate stabilisation, MEG regeneration, drinking and service water and firefighting; or
- storage tanks for holding LNG or other fluids wherein the tanks comprise or are disposed in a superstructure dimensioned to facilitate transfer from a heavy lift vessel to the support structure.

In one embodiment the superstructure comprises one of a prismatic boxlike structure or an open frame structure.

In one embodiment the support structure is configured to support at least one a plant module wholly offshore.

In one embodiment the support structure is configured to support at least one a plant module at a location so that the plant module spans a shoreline and lies partially onshore and partially offshore.

In one embodiment the support structure is configured to support at least one plant module wholly onshore.

In one embodiment the support structure comprises a landing substructure onto which the one or more plant modules are initially transferred from the heavy lift vessel.

In one embodiment the support structure comprises one or more onshore production substructures and a transport path between the landing substructure and the one or more onshore production substructures wherein the one or more plant modules is able to traverse the transport path to facilitate moving of the one or more plant modules from the landing substructure to the one more onshore production substructures.

In one embodiment the transport path comprises one or more rails, tracks or roads.

In one embodiment the transport path is configured to have at least one change in direction.

One embodiment the transport path comprises a turntable capable of supporting a plant module and turning the plant module to facilitate the at least one change in direction.

In one embodiment the LNG plant comprises a traverse system capable of traversing respective plant modules along the transport path.

In one embodiment a respective traverse system is incorporated in each of the one or more plant modules.

In one embodiment the traverse system is separate to the one or more plant modules.

In one embodiment the LNG production plant comprises: at least one plant module arranged as a complete LNG train or a liquefaction facility wherein the support structure for the plant module is located onshore; and at least one LNG storage facility located offshore for storing LNG produced by the LNG train or liquefaction facility. In one form of this embodiment the at least one LNG storage facility is a plant module and the LNG storage facility is supported on an offshore support structure. However in an alternative form of this embodiment the at least one LNG storage facility is a gravity-based. structure or a floating structure.

In a third aspect there is disclosed an LNG production plant comprising:

a superstructure adapted for installation at a pre-determined elevation over a body of water at an LNG production location, said body of water having a floor and a surface, said superstructure comprising one or more superstructure sides, a superstructure base, and, a superstructure deck for receiving a plurality of plant equipment associated with a superstructure liquefaction facility, wherein said superstructure liquefaction facility is operable to produce a first product stream of LNG;

at least one pre-installed foundation is arranged at the LNG production location for receiving said superstructure during an installation operation; the superstructure and the at least one pre-installed. foundation arranged so that the superstructure is capable of being floated onto or skidded onto the at least one pre-installed foundation and, an LNG storage facility for receiving the first product stream of LNG from the superstructure liquefaction facility, wherein said LNG storage facility is external to the superstructure.

In one embodiment, the at least one pre-installed foundation is a plurality of spaced-apart support substructures arranged in an array, said array having an array width and an array length. In one form, the array width is configured to accommodate the passage of a heavy lifting vessel into the array of support substructures during a superstructure installation operation. In one form, the array of support substructures is arranged such that a line extending parallel with the array length is substantially perpendicular to the shore line at the LNG production location. In one form, the array of support substructures is arranged such that a line extending parallel with the array length is substantially parallel to the shore line at the LNG production location.

In one embodiment, each support substructure within the array includes a lower support substructure section fixedly located to the floor of the body of water, and, an upper support substructure section extending substantially vertically upwards from the floor of the body of water, wherein the lower support substructure section of each support substructure terminates in a lowermost support substructure face, and, the upper support section of each support substructure terminates in an uppermost support substructure face disposed at the pre-determined elevation. In one form, the lower support substructure section is anchored to the floor of the body of water by an anchoring system.

In one embodiment, each support substructure in the array is an open truss jacket substructure or a piled substructure.

In one embodiment, the LNG production plant further comprises a substructure transfer means operable to skid the superstructure off the transport vessel working deck of the heavy transport vessel and onto the pre-installed foundation.

In embodiment form, the pre-installed foundation is provided in the form of a plurality of jack-up leg footings in a pre-determined arrangement on the floor of the body of water, and, the superstructure is a self-elevating superstructure supportable at the LNG production location on a corresponding plurality of jackable supporting legs. In one form, each jackable supporting leg is lowered through a corresponding leg guide towards the corresponding pre-installed jack-up leg footing arranged on the floor of the body of water until a lowermost end of each jackable supporting leg is brought into a lowered condition for engagement with each corresponding jack-up leg footing for elevating the superstructure to the pre-determined elevation above the surface of the body of water. In one form, the pre-installed foundation comprises an array of support substructures in combination with at least one jack-up leg footing.

In embodiment form, the external LNG storage facility includes an LNG transfer facility for transferring LNG from one or more cryogenic storage tanks to an LNG Carrier. In one form, the external LNG storage facility is a fixed external LNG storage facility. In one form, the fixed external LNG storage facility is an onshore LNG storage facility. In one form, the external LNG storage facility is a floating external LNG storage facility.

In one embodiment, the external LNG storage facility is incorporated in the hull of an independent LNG production facility, wherein the independent LNG production facility is operable to produce a second product stream of LNG which is stored in the external LNG storage facility. In one form, the independent LNG production facility produces the second product stream of LNG during installation of the pre-installed foundation or during the superstructure installation operation. In one form, the independent LNG production facility is provided in the form of a gravity-based structure which rests on the floor of the body of water at the LNG production location and the external LNG storage facility is arranged within the hull of the gravity-based structure. In one form, the independent LNG production facility is provided in the form of a floating LNG production vessel and the external LNG storage facility is arranged within the hull of the floating LNG production vessel.

In one embodiment, the superstructure is a floatable hull superstructure and the superstructure is floated onto the transport vessel working deck of a semi-submersible heavy transport vessel at a superstructure loading location remote from the LNG production location. In one form, the superstructure is an open truss superstructure or a floatable hull superstructure and the superstructure is skidded onto the transport vessel working deck of a heavy transport vessel at a superstructure construction location.

In one embodiment, the transport vessel working deck has a working deck width and the superstructure base has a superstructure base width that is wider than the working deck width wherein the superstructure includes a first overhanging portion extending proud of a first longitudinal working deck side and a second overhanging portion extending proud of a second longitudinal working deck side.

In one embodiment, the superstructure is one of a plurality of superstructures, each superstructure being receivable on a corresponding plurality of pre-installed foundations.

In one embodiment, the LNG production further comprises one or more expansion phase superstructures installed on one or more corresponding expansion phase pre-installed foundations, each expansion phase superstructure having an expansion phase liquefaction facility operable to produce an expansion phase product stream of LNG. In one form, each expansion superstructure is added simultaneously or sequentially.

In one embodiment, the external LNG storage facility is one of a plurality of external LNG storage facilities.

In one embodiment, the superstructure liquefaction facility is pre-installed upon the superstructure deck at a construction location remote from LNG production location.

In one form, the LNG production location is a near-shore location.

In a fourth aspect there is disclosed a method of installing an LNG production plant comprising the steps of:

a) transporting a superstructure adapted for installation at a pre-determined elevation over a body of water at an LNG production location, said body of water having a floor and a surface, said superstructure comprising one or more superstructure sides, a superstructure base, a superstructure deck for receiving a plurality of plant equipment associated with a superstructure liquefaction facility, wherein said superstructure liquefaction facility is operable to produce a first product stream of LNG;
b) installing at least one foundation at the LNG production location prior to arrival of the superstructure at the LNG production location, the at least one foundation arranged for receiving said superstructure by way of a skid on or a float on installation operation;
c) locating a LNG storage facility external to the superstructure; and
d) connecting the LNG storage facility to the superstructure liquefaction facility for receiving the first product stream of LNG from the superstructure liquefaction facility.

In one embodiment, the superstructure is pre-loaded on a heavy transport vessel, the heavy transport vessel having a transport vessel working deck configured to receive at least a portion of the superstructure base during a superstructure pre-loading operation. In one form, the heavy transport vessel is manoeuvred at the LNG production location in a deballasted draft condition towards the pre-installed foundation so as to align said superstructure with the pre-installed foundation. In one form, the heavy transport vessel is ballasted towards the floor of the body of water to establish a first ballasted draft condition so that the superstructure base is brought into contact with the pre-installed foundation. In one form, the heavy transport vessel is further ballasted towards the floor of the body of water to establish a second ballasted draft condition for unloading the superstructure from the transport vessel working deck of the heavy transport vessel onto the pre-installed foundation. In one form, the heavy transport vessel is manoeuvred away from the pre-installed foundation to complete the superstructure installation operation, with the heavy transport vessel maintained in the second ballasted draft condition.

In one embodiment, the method further comprises the step of removing the superstructure from the pre-installed foundation for relocation from a first LNG production location for installation at a second LNG production location.

In one embodiment, the superstructure is a floatable hull superstructure and the superstructure is floated onto the transport vessel working deck of a semi-submersible heavy transport vessel at a superstructure loading location remote from the LNG production location.

In one embodiment, the superstructure is an open truss superstructure or a floatable hull superstructure and the superstructure is skidded onto the transport vessel working deck of a heavy transport vessel at a superstructure construction location.

In one embodiment, the superstructure is one of a plurality of superstructures, each superstructure being receivable on a corresponding plurality of pre-installed foundations.

In one embodiment, the method further comprises the step of installing one or more expansion phase superstructures on one or more corresponding expansion phase pre-installed foundations, each expansion phase superstructure having an expansion phase liquefaction facility operable to produce an expansion phase product stream of LNG.

In one embodiment, each expansion superstructure is installed simultaneously or sequentially.

BRIEF DESCRIPTION OF THE FIGURES

Notwithstanding any other forms which may fall within the scope of the plant and method as set forth in the Summary, specific embodiments will now be described in detail, by way of example only, with reference to the accompanying figures, in which.

Figure 3:
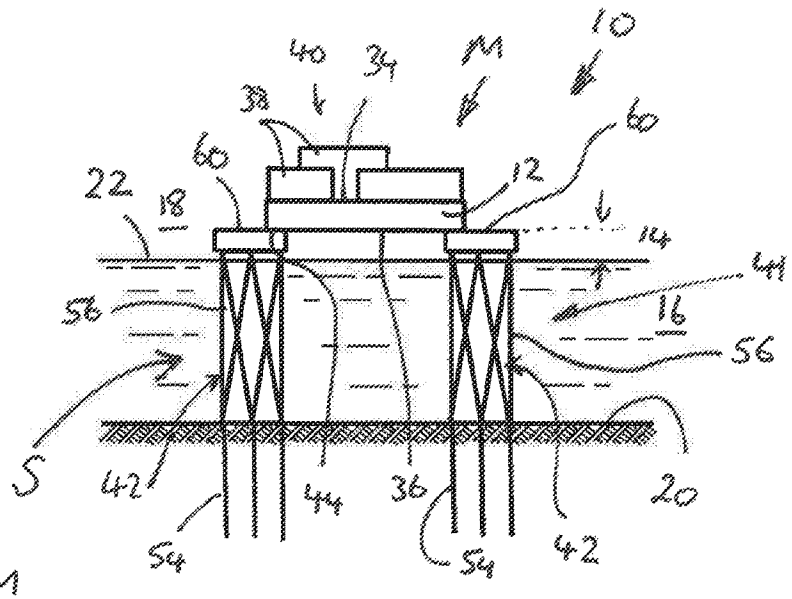
FIG. 3 is a schematic end view of the embodiment illustrated in FIG. 1 as viewed from one end of the superstructure facing towards the shore line.
Figure 1:
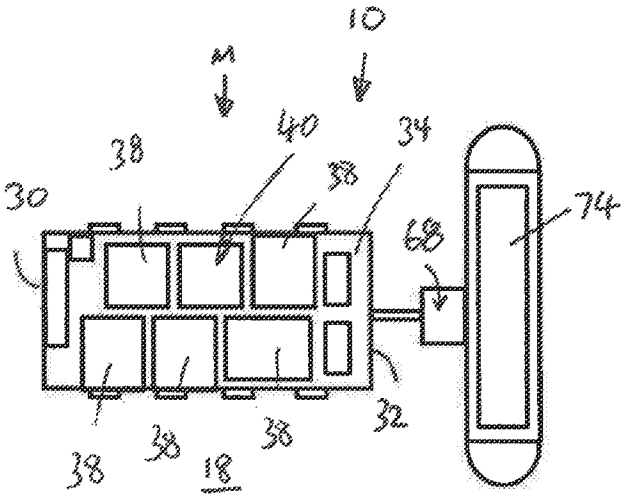
FIG. 1 is a schematic plan view of a first embodiment of the disclosed LNG production plant illustrating an associated plant module and support structure at a near-shore location with an LNG Carrier shown adjacent to an external LNG storage facility.

It is to be noted that the Figures illustrate only preferred embodiments of the disclosed LNG production plant and method of construction and are therefore not to be considered limiting of their scope. Like reference numerals refer to like parts. The components in the Figures are not necessarily to scale, emphasis instead being placed upon illustrating the principles of the disclosed LNG production plant and associated method of construction. Moreover, all Figures are intended to convey concepts, where relative sizes, shapes and other detailed attributes may be illustrated schematically rather than literally or precisely.

DETAILED DESCRIPTION

Particular embodiments of the disclosed LNG production plant and method of construction arc now described. The terminology used herein is for the purpose of describing particular embodiments only, and is not intended to limit the scope of the disclosed plant and method. Unless defined otherwise, all technical and scientific terms used herein have the same meanings as commonly understood by one of ordinary skill in the art to which the disclosed plant and method belong.

The term 'heavy lift vessel' (HLV) refers to a marine vessel that is capable of carrying heavy loads that normal marine vessels cannot carry. One example of a heavy lift vessel is a semi-submersible transport vessel.

The term 'draft' refers to the distance between the surface of a body of water at a given location and the lowermost point of a marine vessel, typically the keel or the soffit of the marine vessel.

As used herein and in the claims the acronym 'LNG' refers to liquefied natural gas.

The term 'LNG Carrier' refers to a marine transport vessel that is capable of carrying a cargo of liquefied natural gas over water.

The phrase 'LNG production plant' means a plant that produces LNG. The phrase 'liquefaction facility' means a facility that processes a feed stream that includes gaseous methane into a product stream that includes liquid methane. A liquefaction facility includes at least one cryogenic heat exchanger and at least one refrigerant compression system.

The term 'onshore' as used in this specification and in the claims refers to a location that is entirely on land, preferably near a shore-line.

The term 'offshore' as used in this specification and in the claims refers to a location that is arranged entirely in or over a body of water, preferably near a shore-line.

The term 'shore-line' refers to the line where an off shore location meets an onshore location. It will be understood that due to tidal movement the exact location of the shoreline will vary on a diurnal and monthly basis.

The term 'near-shore location' as used in this specification and in the claims refers to a location where the water depth is sufficiently shallow for a fixed substructure, in the range of 10 to 30 meters, or in the range of 8 to 50 meters.

Various embodiments of an LNG production plant are now described in detail. In each of these embodiments, the LNG production plant comprises one or more a dry transportable plant modules and a support structure having a fixed altitude. The support structure has a fixed altitude by virtue of it having foundations embedded in the ground whether that ground is onshore or offshore. The support structure is also configured to receive the one or more plant modules transferred from a HLV without one or more the plant modules being lifted from a deck of the HLV. As explained in greater detail below the one more plant modules can be transferred from a HLV by for example:

- varying the ballast of the HLV so that the HLV can be sunk while the plant module is positioned to seat on the support structure (this is known in the art as transfer by "floating off");
- skidding the plant module from the HLV onto the support structure;
- driving the plant module from the HLV onto the support structure;
- pulling or pushing or both the plant module from the HIV onto the support structure.

The support structure is further arranged to support the one or more plant modules when the one or more plant modules are operational within the LNG production plant.

The support structure can be wholly offshore, wholly onshore, or have one portion that is offshore and another portion is onshore. Accordingly the support structure can support a plant module wholly offshore, wholly onshore, or partially onshore and partially offshore.

The support structure comprises a landing substructure onto which the one or more plant modules are initially transferred from the HLV. The landing substructure can be wholly offshore, wholly onshore, or partially onshore and partially offshore. When the landing substructure is wholly offshore then the plant module is also wholly supported offshore. In such an embodiment of the disclosed LNG production plant the LNG production plant may also comprise one or more LNG facilities that are located offshore such as for example an LNG storage tank. Such an LNG storage tank may be embodied in a plant module or as a separate structure is disposed in the water.

In some embodiments of the LNG production plant the support structure comprises one or more onshore production substructures and a transport path between the landing substructure and the one or more onshore production substructures. In these embodiments a traverse system enables the one or more plant modules to traverse the transport path to facilitate moving of the one or more plant modules from the landing substructure to the one more onshore production substructures. For example the landing substructure may comprise a plurality of capped piles some offshore and some onshore; the onshore production substructures may comprise one or more plinths or compacted pads; and the transport path may be in the form of rails, tracks or a road extending from the landing substructure to the onshore production substructures.

Irrespective of whether the landing substructure is onshore, offshore, or partly onshore and offshore the disclosed method contemplates the installation of the landing, substructure prior to the arrival on the HIV of the plant modules. Thus at least the landing substructure is pre-installed at an associated LNG production plant location. It is also preferable that the onshore production substructures, when incorporated in the associated system and method, are pre-installed on us ready for receipt of associated Plant modules.

The transport path may comprise one or more bends or changes of direction or facilities that enable a change of direction such as a turntable. Thus in one example a plant module may be carried by a heavy lift vessel across a body of water to a landing substructure. The buoyancy of the heavy lift vessel may then be adjusted for example by adding or dumping ballast so that one or more contact surfaces of the plant module lie at an altitude substantially flush with an altitude of a support surface of the landing substructure. Subsequently the plant module can be transferred to the landing substructure without being lifted. Once on the landing substructure the plant module can be moved along the transport path to a designated production substructure. When the production substructure is not in a direct line with the landing substructure the transport path must enable a change in direction of travel of the plant module. This nay be facilitated by providing the transport path with one or more bends or alternately by provision of a turntable that allows connection between a first straight path aligned with the landing substructure and another straight path which extends obliquely to the first straight path.

Embodiments of the disclosed method and system envisage the plant module is capable of moving along the transport path by any one of a variety of ways including but not limited to:

- skidding the plant module along the path using either one or more self-contained motors (for example hydraulic motors) and either an internal or external power source for the motors;
- driving the module along the path using self-contained and powered prime mover;
- providing retractable/extendable wheels on the plant module and using a machine to pull or push the plant module when the wheels are extended;
- providing the support structure with one or more carriages onto which the plant module is seated when initially landed on the landing substructure.

In some embodiments at least one of the plant modules may have a superstructure configured to be supported by the support structure. The superstructure may take the form of a hull having a rectangular prismatic which is able to float in water. Alternatively the superstructure may be in the form of an open frame structure, also known as a multi-support frame (MSF). In both of these examples this superstructure has one or more superstructure sides, a superstructure base, and, a superstructure deck.

The superstructure may house or otherwise contain mechanisms, devices or systems to: facilitate the motion of a plant module on the transport path. Such mechanisms, devices or systems may include but are not limited to:

- Skid shoes which may enable the plant module to be skidded along a plurality of metal tracks or rails. The skid shoes may be steerable or mounted in a mariner to enable them to self-follow a bend or change in direction of the track or rail.
- Idler wheels which enable the plant module to be pushed or pulled along transport path. The idler wheels maybe mounted on hydraulic jacks or other mechanisms to enable them to be extended or retracted. When extended the wheels contact the transport path and when retracted the wheels are spaced above the transport path.
- Driven wheels or a driven continuous track (for example similar to a tank track) and an associated motor such as a hydraulic motor for providing torque to the wheels or track. In such an embodiment power may be provided to the hydraulic motor either through an external source or by an on-board power source such as a diesel engine. When an on-board power source is provided the combination of the wheels, motor and power source constitute a prime mover.

The superstructure may also contain or house plant, equipment, systems or mechanisms that have functionality in terms of the overall LNG plant. Examples of this include internal tanks or other storage facilities for the storage of various fluids including but not limited to refrigerant, LNG, condensate and mono-ethylene glycol (MEG). While such storage facility if included in the superstructure of any one plant module may not provide sufficient volume by itself to hold a required volume of fluid for the start-up and/or ongoing operation of the LNG production plant the storage facility of a number of superstructures may be plumbed together to provide sufficient volume.

The plant modules may take one of many forms including but not limited to:

- the superstructure on or in which plant and equipment for performing or supporting a process step in the production of LNG can be mounted and installed and dimensioned to facilitate transfer from a HLV to the support structure and in particular the landing substructure;
- a complete LNG train which includes: the superstructure dimensioned to facilitate transfer from a HLV to the support structure and in particular the landing substructure; and plant and equipment mounted on the deck of the superstructure required for the pre-treatment of an LNG feed stream and subsequent liquefaction to produce LNG;
- a pre-treatment module which includes the superstructure and plant and equipment mounted on the deck of the superstructure to produce a pre-treated natural gas stream;
- a first refrigerant compression module which includes the superstructure and plant and equipment mounted on the deck of the superstructure to provide compression of a refrigerant, for example the first refrigerant compression model may be a propane compression module;
- a first refrigerant condenser module which includes the superstructure and plant and equipment mounted on the deck of the superstructure to condense a refrigerant, for example the first refrigerant condenser module may be a propane condenser module;
- a liquefaction module which includes a superstructure and plant and equipment mounted on the deck of the superstructure to liquefy a vapour;
- a second refrigerant compression module which includes a superstructure and plant and equipment on the superstructure to perform compression of a second refrigerant, for example the second refrigerant compression module may be a mixed refrigerant (MR) compression module;
- a utilities module which may include for example plant, facilities or equipment for one or a combination of two or more of power generation, condensate stabilisation, MEG regeneration, drinking in service water and fire-fighting; or storage tanks for holding LNG or other fluids (the storage tanks in a basic form can be constituted by the above-mentioned superstructure, for example the superstructure may be in the form of a boxlike prismatic structure comprising one or more internal LNG storage tanks).

In other embodiments the plant module may comprise plant and equipment necessary for a combination of two or more of the above plant modules mounted on a common superstructure. The plant modules are sufficiently large in dimension and weight so that dry transport is by and large limited to use of a HLV, for example a plant module which constitutes a complete LNG train may have a weight in the order of 40,000 tonnes. A liquefaction plant module may have a weight of about 25,000 tonnes, and a pre-treatment plant module may have a weight in the order of about 15,000 tonnes. It is envisaged that the plant modules will have a weight in excess of 10,000 tonnes, The disclosed method and system allows for constructing at least one of the plant modules at a construction location or assembling location prior to transport to the production plant location. Additionally testing of the plant modules for verification purposes may be conducted at the construction or assembly location. Within each plant module, the pieces of equipment required to perform the function assigned to that plant module are arranged to minimize interfaces between modules so as to minimize the hook-up that is required to be completed when the modules are delivered from a construction location or assembly location to the production plant location. In this way, a plant module can be essentially self-contained and provided with a temporary control system to allow the module to be switched on for loop checks and commissioning at the construction or assembly location prior to transport to the production location.

Upon arrival at the production plant location, wireless control may be used for inter-modular communication and control to further reduce the hook-up time. At the production plant location if it is desired to minimize the length of interconnecting pipe runs between plant modules, the plant modules may be spaced as closely as possible, while still allowing sufficient room at the production location to hook up the interconnections between plant modules.

OFFSHORE EMBODIMENTS

A first offshore embodiment of the disclosed system and method is now described with reference to FIG. 1 to FIG. 12 in the context of the LNG production plant location being offshore but at a near-shore location.

In some offshore embodiments one or more plant modules are supported on an offshore support structure. The plant modules are dry transported on respective HLVs and transferred onto one or more offshore support structures. In some embodiments a plant module may be connected with onshore plant and equipment associated with a LNG production plant.

An LNG production plant (10) comprises a dry transportable plant module M and a support structure S having a fixed altitude and configured to receive one or more plant modules transferred from a HLV (V). As will be explained shortly the plant module M is transferred from the HLV (V) without lifting module M from a deck of the HLV (V). The support structure S supports the plant module M when the plant module M is operational within the LNG production plant (10).

In this embodiment the plant module M comprises a superstructure (12) which is installed on the support structure S at fixed elevation or altitude (14) over a body of water (16) at a near-shore location (18), the body of water having a floor (20) and a surface (22). The superstructure has one or more superstructure sides (24). When the superstructure has a circular or elliptical footprint, the superstructure has one superstructure side. For ease of construction, the superstructure has a rectangular footprint comprising a first longitudinal side (26), a second longitudinal side (28), a first end (30) and a second end (32), The superstructure has a superstructure deck (34) and a superstructure base (36).

While in some embodiments the plant module M may be constituted by solely the superstructure (12) in this particular embodiment the plant module M is a liquefaction module. Accordingly the superstructure deck (34) is sized for receiving a plurality of plant equipment (38) associated with a liquefaction facility (40) for producing a first product stream of LNG. Liquefaction can be achieved using any liquefaction process well established in the art which typically involve compression, expansion and cooling. Such prior art liquefaction processes include processes based on a nitrogen cycle, the APCI C3/MR™ or Split MR™ or AP-X™ processes, the Phillips Optimized Cascade Process, the Linde Mixed Fluid Cascade process, the Shell Double Mixed Refrigerant or Parallel Mixed Refrigerant process, or the Axens LIQUEFIN™ process. It is not deemed necessary to be described herein for one with ordinary skill in the art. Further, various ancillary equipment, structural details, and, production and processing equipment, are not shown or described in detail, as such would be deemed to be well within the ordinary skill of one in the art, but would be included in the commercial embodiment of the invention.

The plurality of equipment will vary depending on the type of liquefaction process being conducted by the liquefaction facility (40) and is known in the LNG liquefaction art. Advantageously, the superstructure liquefaction facility (40) may be pre-installed upon the superstructure deck (34) at a construction location such as a shipyard, where a trained and cost-efficient labour force is available remote from LNG production plant location. The pre-installed liquefaction facility (40) may also be pre-commissioned at its construction location so that any issues relating to operation of the superstructure liquefaction facility can be addressed before the superstructure is installed at the LNG production location.

Upon completion of a superstructure installation operation at the offshore LNG production location (18), the superstructure (12) is supported at the pre-determined fixed elevation (14) above the surface (22) of the body of water (16). The elevation (14) is determined by the fixed altitude of the support structure S. The support structure S has a fixed altitude by virtue of it being fixed to the ground, which in this embodiment is constituted by the seafloor (20). Preferably the pre-deter finned fixed elevation (14) is set such that the superstructure deck (34) is supported at or above the Highest Astronomical Tide (HAT) level of the LNG production location (18).

The support structure S includes a ground founded landing substructure (41) which has a number of pre-installed capped piles (42). The capped piles (42) facilitate correct positioning of the plant module M. Additionally the capped piles (42) in the offshore embodiments provide support to the superstructure (12) and associated plant module M during operation of the LNG production plant (10).

In the embodiments illustrated in FIG. 1 to 12, the pre-installed. capped piles (42) are arranged in an array (46). The array (46) of capped piles (42) has an array width (48) and an array length (50). The array width and array length are configured to support the superstructure base (36). The array width (48) is configured to accommodate the passage of a heavy lifting vessel (V) into the array (46) during an installation operation described in greater detail below with reference to FIG. 6 to FIG. 12. In the embodiment illustrated in FIGS. 1 to 12, the array (46) is shown with eight capped piles (42) for illustration only. It is to be clearly understood that the number of support substructures may vary, with a minimum of four support substructures being preferable to provide stability when the superstructure has a rectangular footprint.

Referring to FIG. 3, each capped pile (42) includes a lower support substructure section (54) fixedly located to the floor (20) of the body of water (16), and an upper support substructure section (56) extending substantially vertically upwards from the floor of the body of water. The lower support substructure section (54) may be anchored to the floor (20) of the body of water (16) using an anchoring system including but not limited to piles, soil anchors, suction anchors, or caissons.

The upper support substructure section (56) of each capped pile (42) terminates in a support face (60) disposed at the pre-determined elevation (14). During the superstructure installation operation, one or more contact surfaces (44) of the superstructure base (36)/plant module M lie at altitudes substantially flush with an altitude of a support surface (60) of the structure S. Moreover after the installation process the contact surfaces (44) he on and are in abutting contact with the support face (60).

By ensuring that the superstructure (12) is arranged at all times above the surface (22) of the body of water (16) at the LNG production location (18), the cost of construction of the LNG production plant can be significantly lowered compared with floating LNG vessels or gravity based structures as the design of the superstructure does not need to account for force inducing factors associated with changing weather conditions at the surface of the water such as water currents and tidal forces.

Figure 2:
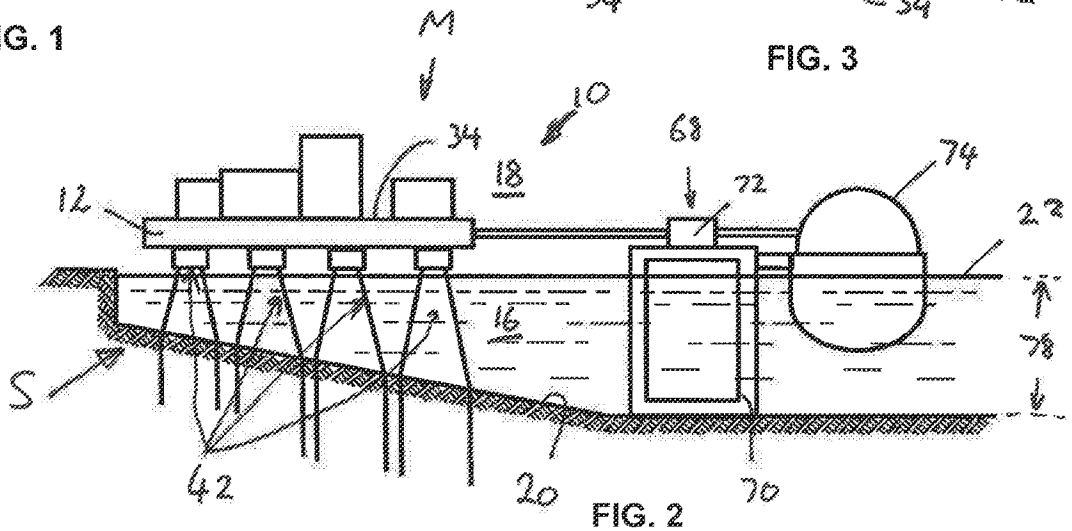
FIG. 2 is a schematic side view of the embodiment illustrated in FIG, 1.

When an embodiment of the disclosed plant (10) is installed at a near-shore location having a floor (20) that is substantially flat with uniform morphology, each of the capped piles (42) within the array (46) may have the same or similar dimensions. However, when the floor (20) of the body of water (16) at the near-shore location (18) is uneven or inclined at an angle away from the shoreline (66), as best seen in FIG. 2, the dimensions of each of the individual capped piles (42) may vary.

By way of example, the relative length of the lower support substructure section (54) and the upper support substructure section (56) may vary between adjacent support substructures in the array (46). Alternatively or additionally, a first subset of support substructures in the array may have a larger cross-sectional area than a second subset of support substructures in the array in anticipation of the first subset of support substructures being subjected to a different load condition than the second subset of support substructures. Other factors that can affect the dimensions of each of the plurality of support substructures in the array can include: the anticipated weight distribution of the plurality of process equipment of the first phase liquefaction facility arranged on the elevated structure deck, variations in local coastal currents, and, variations in the local morphology or geology of the floor of the body of water, or, environmental conditions (e.g. wind, wave, seismic).

Referring back to FIGS. 1 and 2, when installation of the plant module M is completed, the liquefaction facility (40) is operable for producing a first product stream of LNG that is then stored in an external LNG storage facility (68). The external LNG storage facility can be fixed, for example when in the form of a gravity based structure, or floating and includes at least one cryogenic storage tank (70). In this illustrated embodiment the LNG storage facility (68) is not constituted by a plant module. Whilst only one cryogenic storage tank can be seen in the embodiment illustrated in FIG. 2, the cryogenic storage tank may be one of a plurality of cryogenic storage tanks arranged within the external LNG storage facility. The external LNG storage facility may have an LNG storage capacity in the range of 125,000 $m^3$ to 400,000 $m^3$, preferably having an LNG storage capacity of at least 160,000 $m^3$. By way of example, the cryogenic storage tank(s) may be a double containment, full containment, prismatic or membrane systems with a primary tank constructed from, by way of example, stainless steel, aluminium, and/or 9%-nickel steel. Such cryogenic storage tanks are well known to those skilled in the LNG production art.

The external LNG storage facility (68) includes an LNG transfer facility (72) for transferring LNG from the cryogenic storage tank (70) to an LNG Carrier (74). Such LNG transfer facilities are known in the art and include flexible or fixed transfer hoses. To allow sufficient water depth for an LNG Carrier (74) to berth alongside the LNG transfer facility (72), the LNG transfer facility (72) is positioned in an offloading, location (76) that may have a water depth (78) as measured from the surface of the body of water to the floor of the body of water at the offloading location of between 15 and 50 meters.

Figure 6:
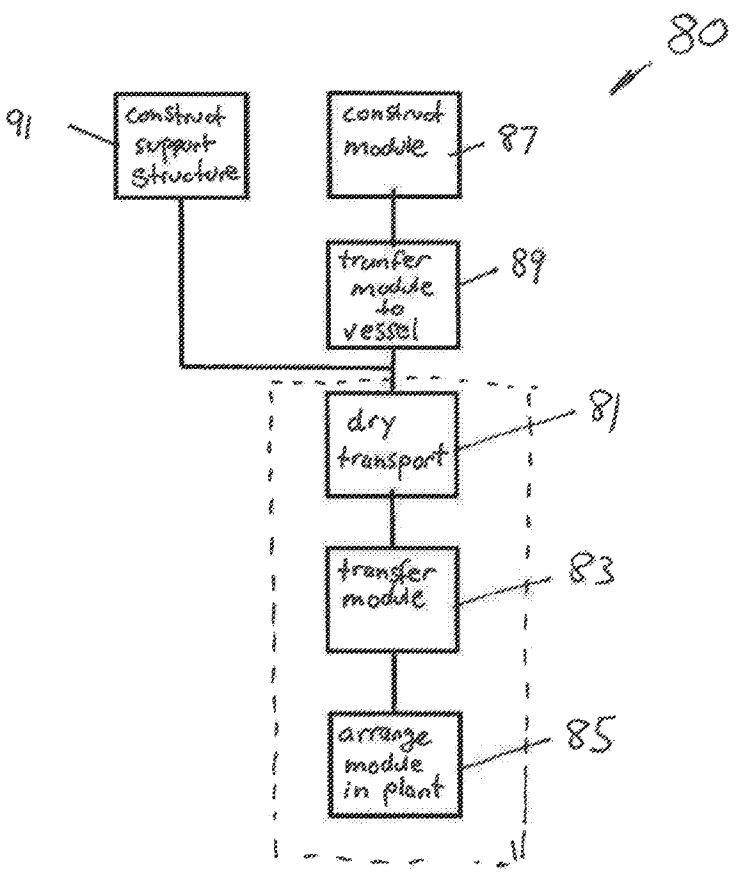
FIG. 6 is a flow diagram illustrating an embodiment of the disclosed method of constructing the LNG production plant shown in FIG. 1.

One embodiment of the disclosed method (80) of constructing the LNG production plant (10) at the LNG production location (18) is now described with reference to FIGS. 6 to 12. With reference to FIG. 6 the method (80) in broad terms entails the following steps:

- step (81) of dry transporting (also known as dry tow) a plant module M on a heavy lift vessel V across the body of water (16);
- step (83) of transferring the plant module M onto the support structure S which is arranged to support the plant module M at an altitude above HAT height, where the transferring is accomplished or otherwise performed without lifting of the plant module M;
- step (85) of arranging the plant module M (which may be one of a plurality of plant modules M which are transported and transferred in the same manner as described above) as, or as part of, the LNG production plant (10) to facilitate the production and/or storage of LNG.

Embodiments of the method (80) may also incorporate additional steps and various steps previously described may themselves comprise numerous sub steps. For example the method (80) may also entail steps (87), (89) and (91). Step (87) is the step of constructing or assembling a plant module M at a construction location or an assembly location which are remote from the production location (18). Step (89) is a step of transferring the plant module M onto the heavy lift vessel (V) so that it can be subsequently dry transported/towed to the structure S as per step (81). The plant module M may be transferred onto the heavy lift vessel (V) in the same ways as the plant module M is transferred onto the support structure S. Although in one variation the plant module M may be lifted by a crane onto the heavy lift vessel (V). Step (91) entails the construction and/or pre-installation of the support structure S. This may occur concurrently with step (87).

The heavy lift vessel (V) has a transport vessel hull (82), a transport vessel working deck (84) arranged towards the topsides of the transport vessel hull, a transport vessel hull base (95), and, a ballasting system (86) for varying the draft of the heavy transport vessel (V). The transport vessel further comprises a fixed structure (88) permanently fixed to the transport vessel hull (93). The bridge of the HLV (V) is positioned within the fixed structure (88). The fixed structure (88) is arranged completely towards one end of the transport vessel to maximise the footprint of the transport vessel working deck (84). The working deck (84) has a polygonal or ship-shaped footprint comprising a forward end (90), an aft end (92), a first longitudinal working deck side (94) and a second longitudinal working deck side (96). The working deck (84) is substantially flat and configured to receive at least a portion of the superstructure base (36) during a superstructure pre-loading operation described in greater detail below. When the fixed structure (88) is positioned towards the forward end (90) of the working deck (84), the working deck width (98) is determined. by the width of the aft end (92).

Two suitable steps (89) for transferring plant module M onto the HLV (V) are referred to in that art as 'float-on' or 'skid-on' loading. For 'float-on' loading, the heavy lift vessel is semi-submersible. This requires that the ballast system (86) is capable of varying the buoyancy of the HLV (V) to adjust the height of the deck (84) as required to either float the plant module M onto or off of the deck (84). In such an embodiment the superstructure (12) of the plant module M is in the form of a hull or barge having a rectangular boxlike structure. To facilitate loading of the superstructure on the working deck (84), the ballasting system (86) of the HLV (V) is operated so that the working deck (84) is fully submerged below the surface of the body of water at the loading location, while the fixed structure (88), including the bridge, intersects the surface of the body of water.

In this configuration, the superstructure (12)/plant module M can be floated on the submerged working deck (84) at a loading location. Cribbing (97) may be arranged on the deck (84) onto which a plant module M/superstructure (12) is loaded. Cribbing (97) is known in the maritime arts for absorbing and to distributing loads on the deck. In this specification all references and descriptions of a plant module M or a superstructure (12) being loaded on the deck (84) is intended to be reference to the deck (84) with or without cribbing.

Figure 13:
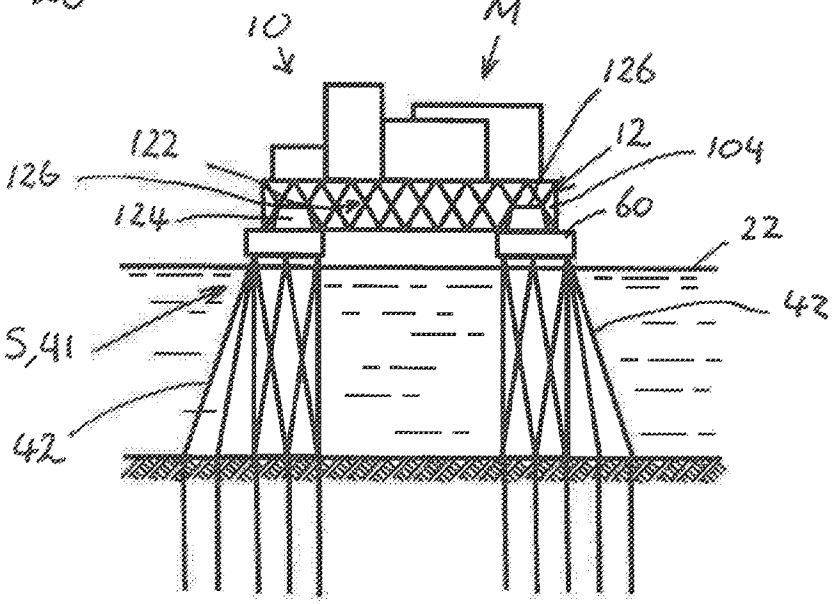
FIG. 13 is a schematic end view of a plant module incorporated in another embodiment of the disclosed LNG production plant in which the superstructure of the plant module is in die form of an open truss superstructure with the superstructure base retained against lateral movement using a suitable locating means removably receivable within a corresponding receiving means arranged within the superstructure base.

Alternatively, when a 'skid-on' operation is used for the plant module M/superstructure (12) loading operation, the superstructure (12) can be provided in the form of a barge or an MSF as illustrated in FIG. 13. Using a skid-on operation, the heavy transport vessel (V) is moored at the superstructure construction location and the ballasting system (86) of the heavy transport vessel (V) is used to maintain a suitable elevation for the skidding transfer of the superstructure (12) onto the transport vessel working deck (84).

FIGS. 7-12 illustrate a "float over" method of transferring the plant module M from the HLV (V) to the support structure S and more particularly the landing substructure (41). The heavy transport vessel (V) is manoeuvred at the near-shore location (18) to align the superstructure (12)/plant module M with the array (46) of capped piles of (42), More specifically, first and second overhanging portions (108 and 110, respectively) of the superstructure (12) are aligned with the array (46) as best seen from the top views illustrated in FIGS. 7 to 9 and the side views illustrated in FIGS. 10 and 11.

The heavy lift vessel (V) may include a dynamic positioning system to assist in positioning the vessel between the capped piles (42). Alternatively or additionally, the heavy transport vessel V may be manoeuvred with the assistance of a support vessel such as a tug or a group of tugs. In either case the heavy transport vessel (V) is manoeuvred until the first and second overhanging portions (108 and 110, respectively) of the superstructure (12) are positioned in alignment above support face (60) of the support structure S/landing substructure (41).

The ballast system (86) of the heavy lift vessel (V) is now further operated to decrease the buoyancy of the HLV (V) sinking it toward the floor (20) so that the contact surfaces (44) of the superstructure base (36)/plant module M, which are on an under surface of the first and second overhanging sections (108 and 110, respectively), are brought into contact with support face (60). The ballast system (86) is thus initially operated so that the contact surfaces (44) of the plant module lie at an altitude substantially flush with an altitude of a support face (60) of the structure S.

Figure 12:
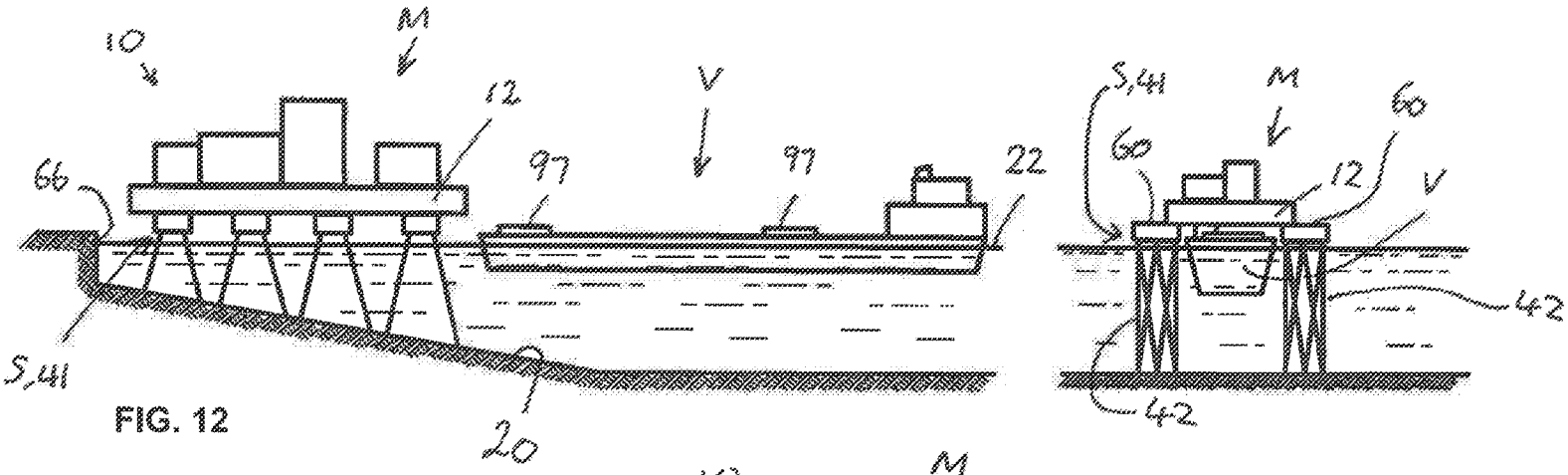

The buoyancy of the heavy transport vessel (V) is now further decreased by adding more ballast to the ballasting system (86) so that the deck (84) of the HLV (V) is spaced from the contact surfaces (44) of the superstructure (12)/plant module M. Subsequently, as shown in FIG. 12 the HLV (V) can be sailed from underneath the superstructure (12)/plant module M and outside of the support structure S.

Once clear of the support structure S and associated array (46), the ballasting system (86) of the heavy lift vessel (V) is operated to restore the draft of the heavy transport vessel to a nominal draft that is optimal for the heavy lift vessel (V) in the absence of carrying a plant module M or associated superstructure (12).

By reversing the installation process described above with reference to FIGS. 6 to 12, the superstructure (12)/plant module M can be removed from the support structure S for relocation from a first LNG production location to a second LNG production location at a later time to suit LNG supply and demand, for example, due to changes in the capacity of the LNG production plant or towards the end of a gas field life. Advantageously, this allows for maintenance to be conducted, if required, on the superstructure or the superstructure liquefaction facility located on the superstructure deck.

FIG. 13 illustrates a different form of plant module M that may be incorporated in embodiments of the disclosed plant and method. The plant module M differs from that described with reference to and shown in FIGS. 1-12 only by virtue of the configuration of its superstructure (12) which is now provided in the form of a MSF (104). The MSF is an open truss superstructure formed of steel tubular units which are terminally welded one to another. The MSF (104) provides a space (122) can be used as a work space or maintenance space of sufficient height and strength to allow access by personnel and equipment.

Upon completion of the superstructure installation operation, the superstructure base (36) is retained against lateral movement relative to the array (46) of support structures S using a suitable locating means such as a locating cone (124). One example of a suitable locating means is a locating cone provided on each support face (60). Each cone (124) is removably receivable within a corresponding receiving means (126) arranged within the superstructure base (36).

Various other alternative embodiments of the support structure S and associated landing substructure (41) are now briefly described with reference to FIGS. 14 to 38.

Figure 15:
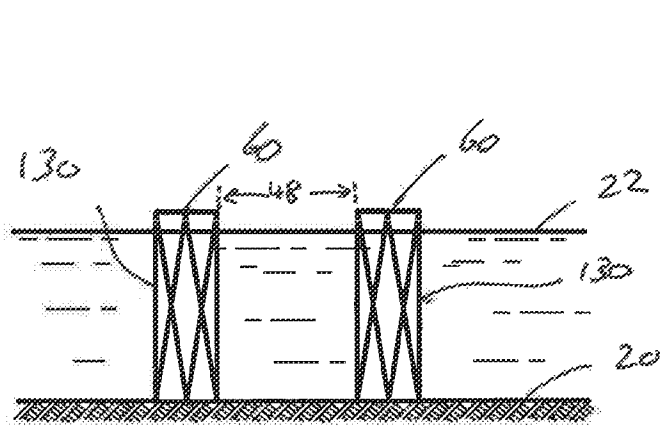
FIG. 15 is a schematic end view of the embodiment illustrated in FIG. 14.
Figure 14:
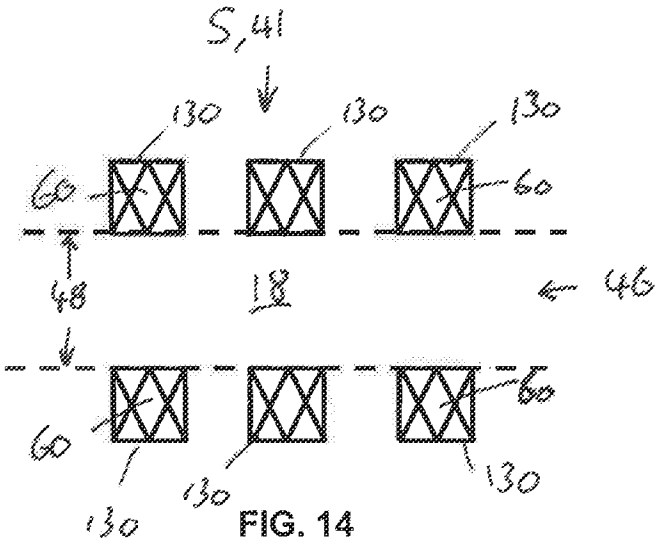
FIG. 14 is a schematic top view of a pre-installed support structure provided in the form of a plurality of spaced-apart open truss jacket substructures that may be incorporated in a further embodiment of the disclosed LNG production plant.
Figure 16:
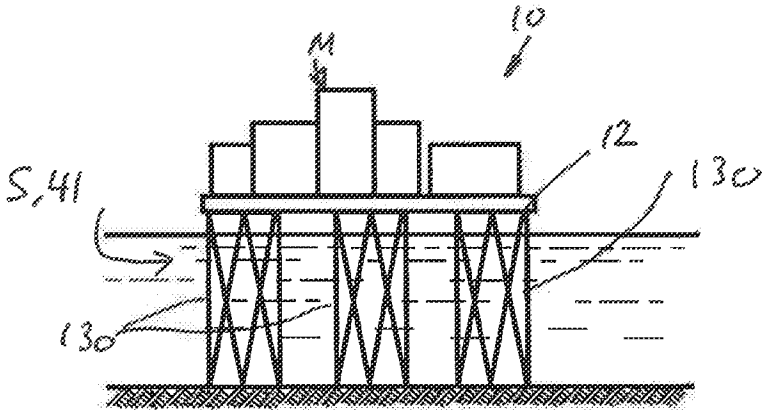
FIG. 16 is a schematic side view of the embodiment illustrated in FIG. 14 with the superstructure installed on the spaced-apart open truss jacket substructures.

In the embodiment illustrated in FIGS. 14 to 16, the support structure S and corresponding landing substructure (41) is in the form of an array (46) of open truss jacket substructures (130) rather than the capped piles (42). Otherwise the plant (10) and method of construction is in essence the same as described above in relation to the embodiment shown in FIGS. 1-12.

Figure 18:
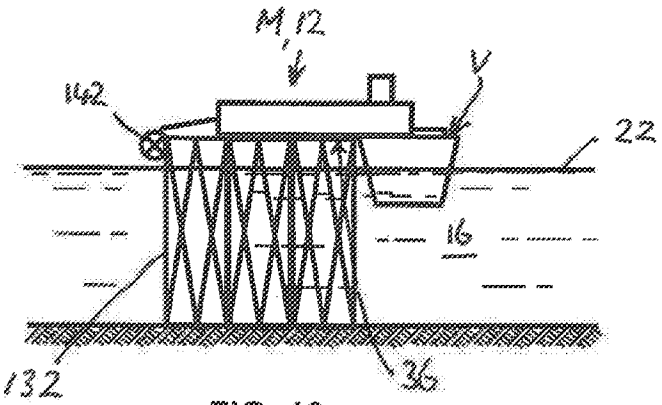
FIG. 18 is a schematic end view of the embodiment illustrated in FIG. 17 showing planar alignment of the plant module base with a horizontal plane formed by the support structure with the plant module simultaneously being supported by both the heavy lift vessel support structure.
Figure 20:
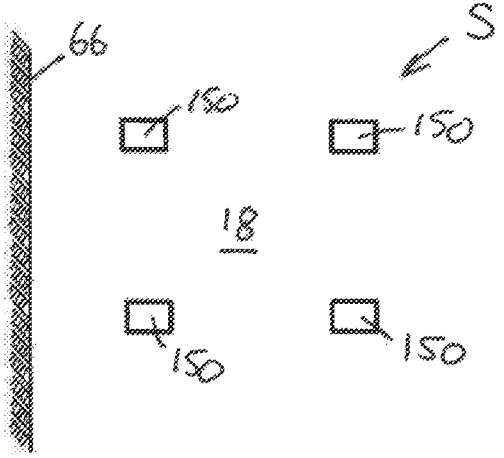
FIG. 20 illustrates a schematic top view of a form of the support structure that may be incorporated in an alternate embodiment of the LNG production plant in which an associated at plant module includes one or more jack-up legs.
Figure 17:
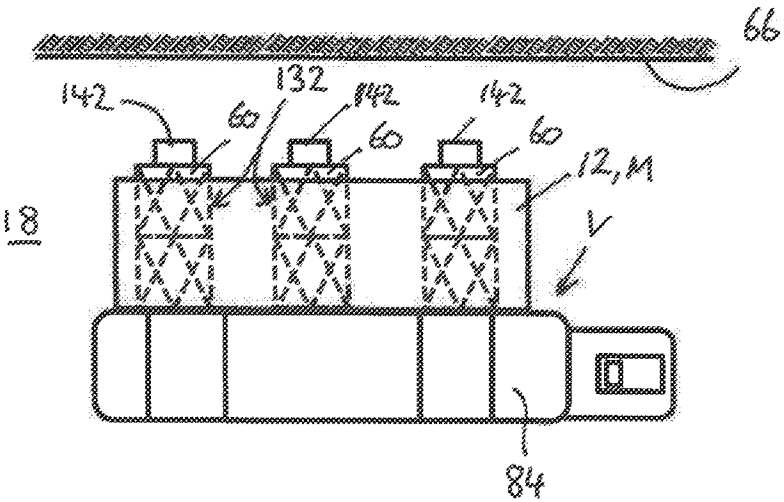
FIG. 17 is a schematic top view illustrating a step in the disclosed method of transferring a plant module from a heavy lift vessel onto a support structure by a skid off operation.
Figure 19:
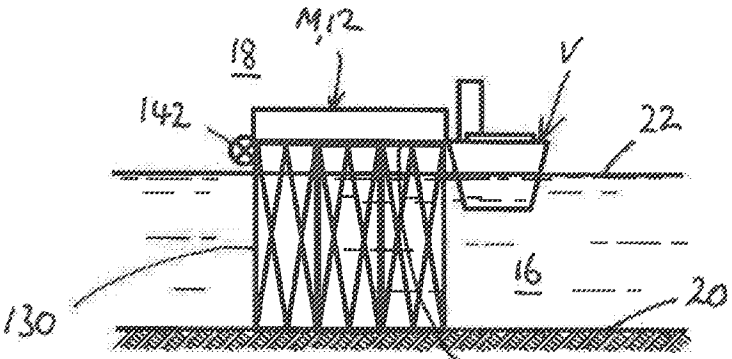
FIG. 19 is a schematic end view of the production plant with the plant module skidded completely off the vessel and now fully supported only on the support structure.

In the embodiment of the plant (10) illustrated in FIGS. 17 to 19, the support structure S and corresponding landing substructure (41) is in the for u of a plurality of open truss substructures (130) as described above in relation FIGS. 14-16. However the method (80) of transfer from the HLV (V) to the structure S is different. Rather than using a transfer step (83) of a float over the plant module M as previously described; a skid off transfer step (83) is used. In these Figures the plant module M is shown simply in the form of a superstructure (12). However the plant module M and may take any of the forms previously described.

Referring to FIGS. 17 and 18, the superstructure (12) is transported from a loading location to the LNG production location (18) by the heavy lift vessel (V). After arrival at the LNG production location (18), the heavy lift vessel (V) is positioned alongside the one side of the support structure S/landing substructure (41) and its buoyancy varied to adjust its draft so that the contact surfaces (44) on the superstructure base (36) are at substantially the same altitude with a horizontal plane formed by the support face (60) of the open truss substructures (130). Once alignment has been achieved, a winch system (142) is operated to skid the superstructure (12) off the heavy lift vessel (V) and onto the support structure S.

A further embodiment of the plant (10) is shown in FIGS. 20-24 in which the support structure S comprises a combination of jack-up leg footings (150) installed on the floor (20) and corresponding jack-up legs (154) which are a part of the plant module M/superstructure (12). In this embodiment the footings (150) are arranged in a rectangular configuration near the shoreline (66).

In this embodiment, the plant module M is a self-elevating structure by virtue of the plurality of jackable supporting legs (154). The superstructure (12) is provided in the form of a boxlike floatable hull or barge. Each jackable supporting leg, which may be circular, square or triangular in cross-section, is moveable through a leg guide (156), each leg guide (156) extending through the superstructure base (36) and superstructure deck (34).

Figure 21:
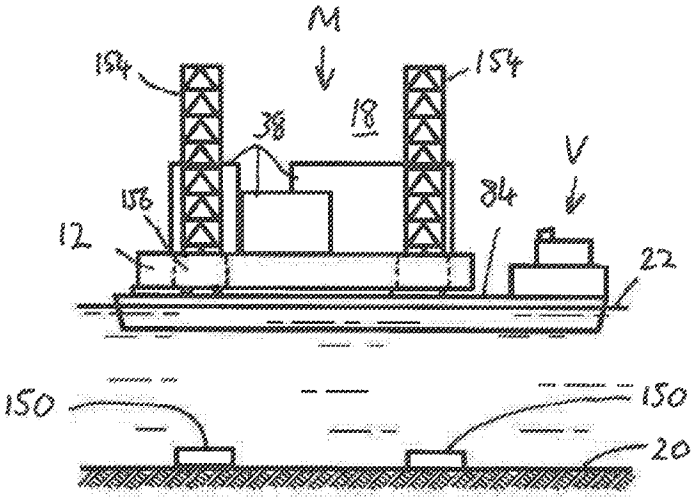
FIGS. 21 to 24 schematically illustrate an embodiment of the disclosed LNG production plant and method of construction which utilise plant modules and/or associated substructures provided with jack-up legs.
Figure 22:
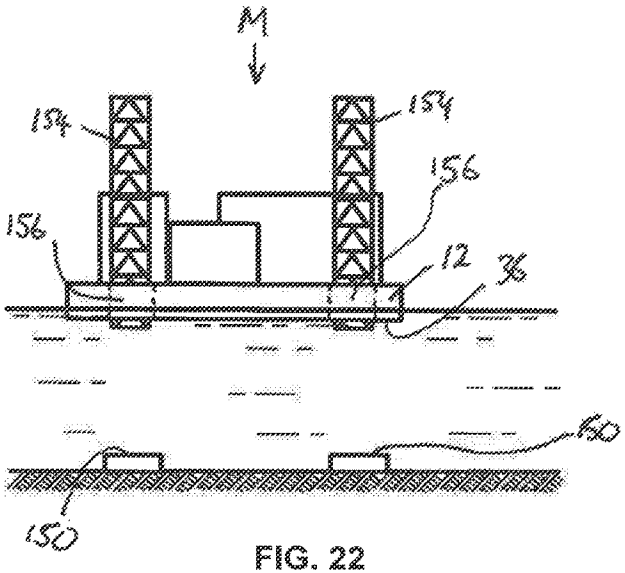
Figure 23:
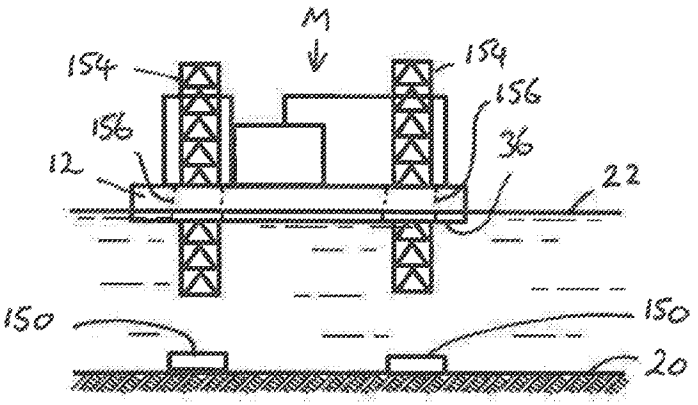
Figure 24:
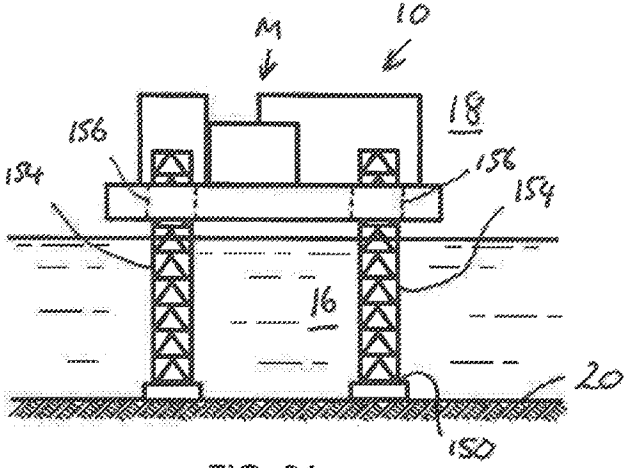

As best seen in FIG. 21, the plurality of lockable supporting legs (154) is supported by the superstructure (12) in a raised condition during dry transport on the HIV (V). Once the superstructure (12) has been delivered to the LNG production location (18) and positioned in alignment with the plurality of jack-up leg footings (150) that have been pre-installed at said LNG production location (18), the HLV (V) is ballasted to submerge to the extent required to float the plant module M off the working deck (84) and over the footings (150). The heavy lift vessel (V) is then manoeuvred away from the LNG production location (18). The jackable supporting legs (154) are lowered through their corresponding leg guides (156) towards and brought into engagement with each corresponding jack-up leg footing (150) as shown in FIGS. 23 and 24. Subsequently the jackable legs (154) are operated to lift the superstructure base (36) above the surface (22) of the body of water (16) and in particular above the HAT.

Figure 25B:
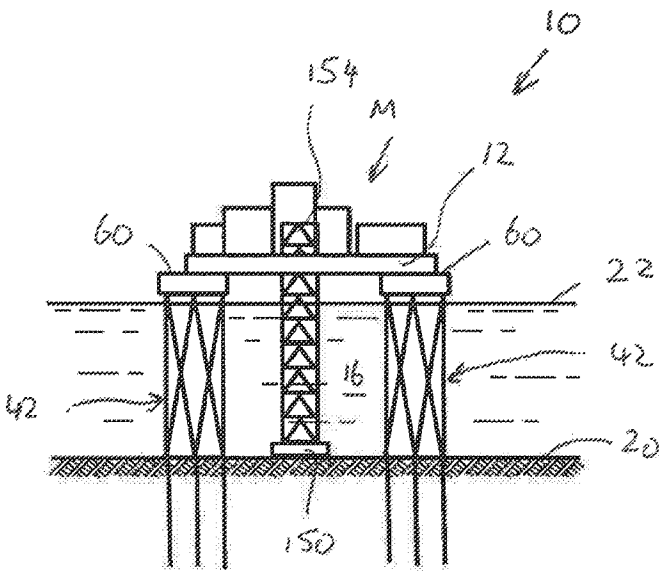
FIG. 25*b* is an end view of a form of plant module that may be incorporated in the embodiment of the LNG production plant having the support structure shown in FIG. 25*a* in which the plant module has at least one centrally located jack-up leg.
Figure 25A:
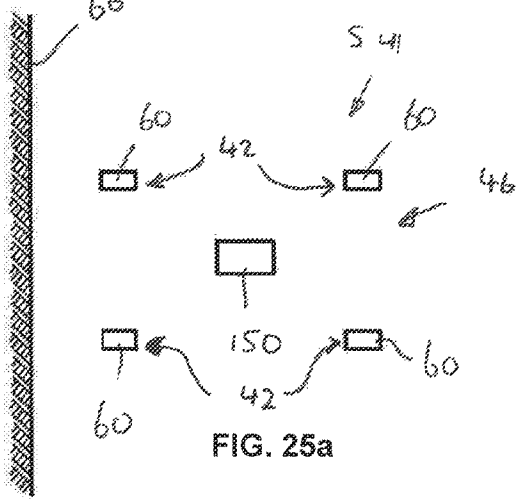
FIG. 25*a* is a plan view of part of a support structure incorporated in a further embodiment of the disclosed LNG production plant and associated method of construction.
Figure 25C:
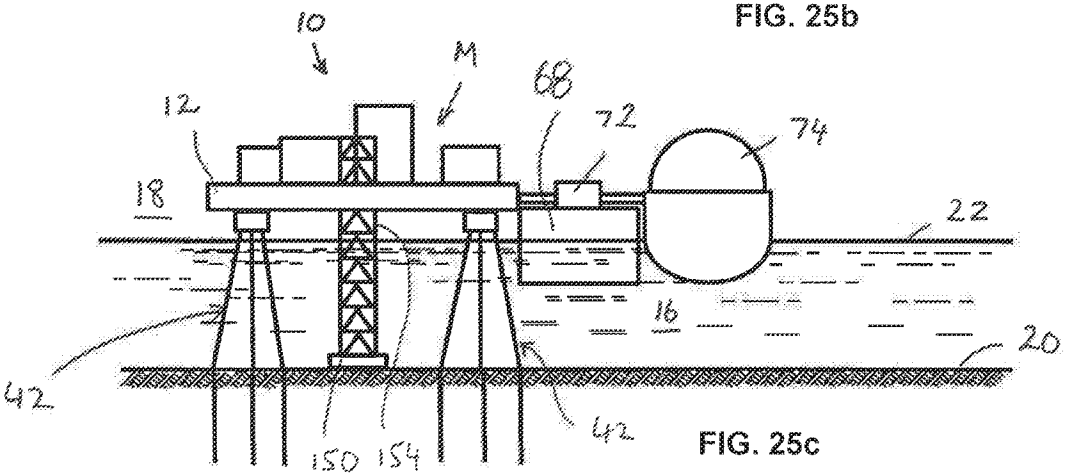
FIG. 25*c* is a side view of the embodiment of the LNG production plant shown in FIG. 25*b;*

FIGS. 25*a* to 25*c* depict an embodiment of the LNG plant (10) and corresponding method (80) of installation may be considered to be a hybrid of the embodiments shown with reference to FIGS. 1-6 and FIGS. 20-24. The plant module M in this embodiment may be of identical form to that shown and described in relation to FIGS. 1-6 but in addition includes a central jackable leg (154). The support structure S and associated landing substructure (41) in this embodiment of the LNG plant (10) comprises a plurality of capped piles (42) having support surfaces (60) which lie in a common plane so as to support at least the superstructure deck (34) at or above the Highest Astronomical Tide (HAT) level of the LNG production location (18), together with a jack-up leg footing (150) that is installed on the seafloor (20). The jackable leg (154) and the footing (150) simply act as an additional support to the plant module M and superstructure (12) in a manner in essence identical to the capped piles (42). This form of an embodiment may be particularly suitable when the plant module M is of a size and/or configuration such that support in a central region of the module M is required to counter bending moments.

As would be readily apparent to those skilled in the art any number of jackable legs (154) and corresponding footings (150) may be provided between the fixed capped piles (42) depending on the size and configuration of the module M to counteract bending moments or other loads on the plant module M and superstructure (12).

While the superstructure (12) could be provided with storage capabilities in the illustrated embodiment and external floating LNG storage facility (68) and associated LNG transfer facility (72) are provided for transferring LNG to the LNG Carrier (74).

Other arrangements for the incorporation of an external LNG storage facility (68) are now described with reference to FIGS. 26 and 27. In each of these figures, the pre-installed foundation (42) has been omitted for the sake of clarity.

Figure 26:
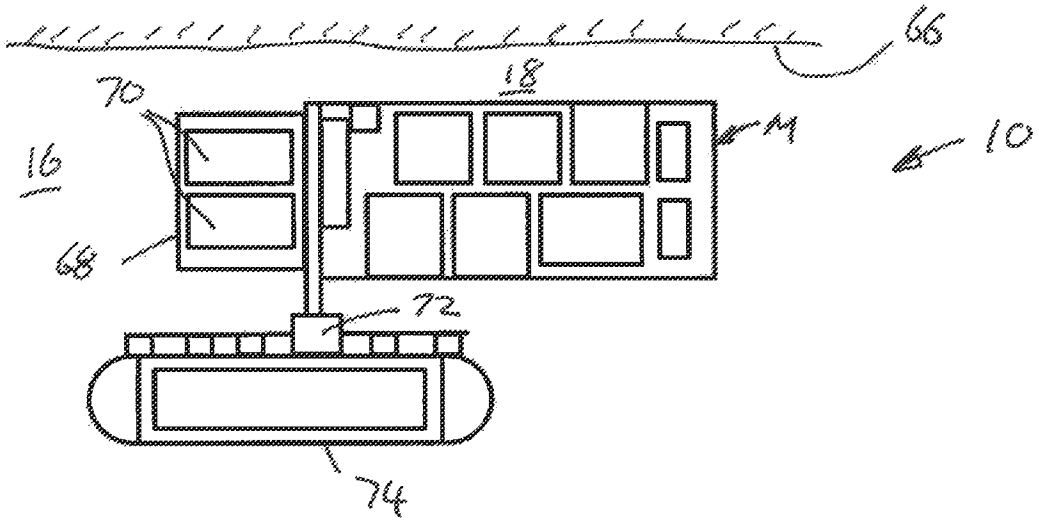
FIG. 26 is a schematic top view of one embodiment of the LNG production plant after installation of a plant module at the LNG production location with the plant module incorporating a liquefaction facility operable for producing a first product stream of LNG that is then stored in a fixed external LNG storage facility that is arranged separate from but adjacent to an end of the plant module such that the external LNG storage facility is positioned between the plant module and a LNG transfer facility.

In the embodiment illustrated in FIG. 26, when installation of plant module M at the LNG production location (18) is completed, the liquefaction facility (40) is operable for producing a first product stream of LNG that is then stored in the at least one cryogenic storage tank (70) of the external LNG storage facility (68). The external LNG storage facility (68) is a fixed external LNG storage facility that is arranged separate from but adjacent to the plant module M and associated superstructure (12) such that the external LNG storage facility (68) is positioned between the superstructure (12) and the LNG transfer facility (72) used for transferring LNG from the cryogenic storage tank (70) to the LNG Carrier (74) berthed at the LNG transfer facility (72).

Figure 27:
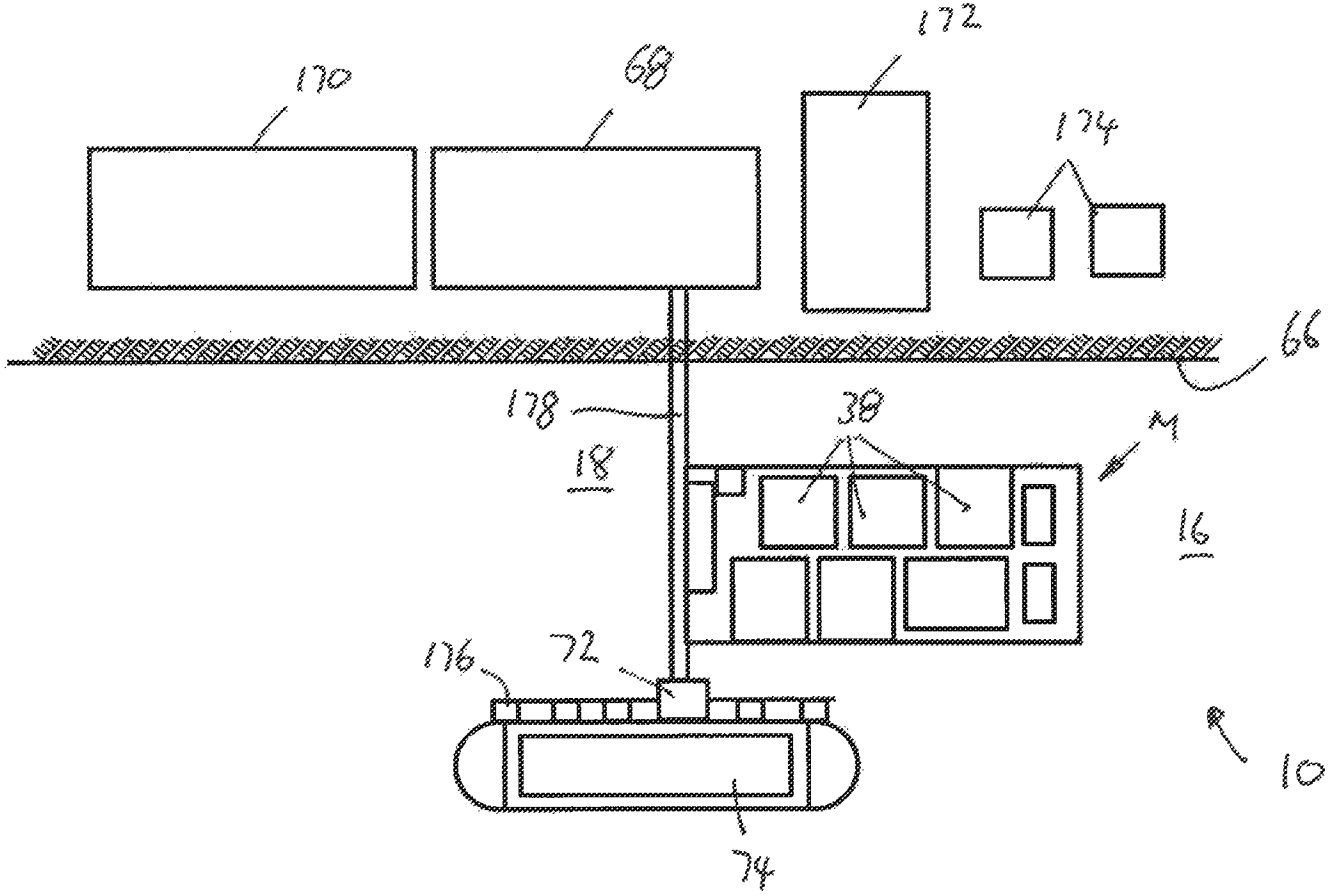
FIG. 27 is a schematic top view of one embodiment of the LNG production plant after installation of a plant module at the LNG production location in which external LNG storage facility is provided as an onshore LNG storage facility with other facilities associated with the LNG production plant including a maintenance facility, a utilities facility and an accommodation facility located onshore.
Figure 28:
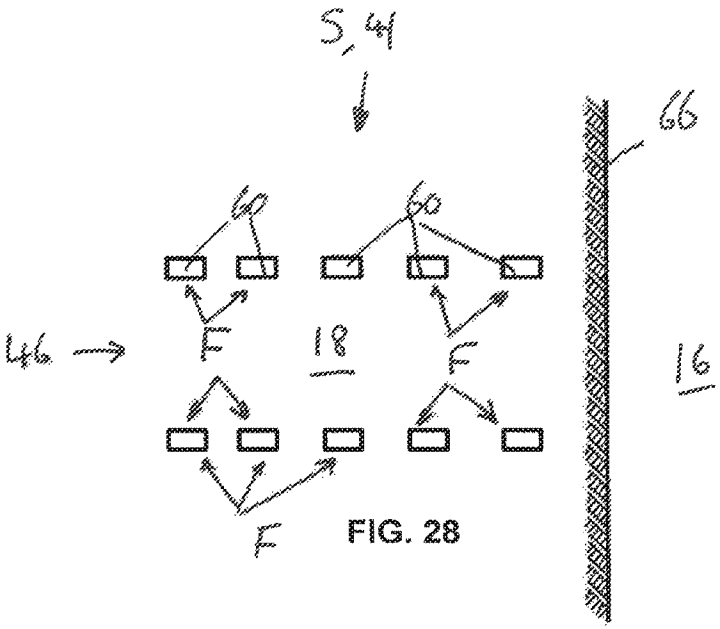
FIG. 28 is a plan view of a support structure incorporated in an onshore embodiment of the disclosed plant and method of construction.
Figure 29:
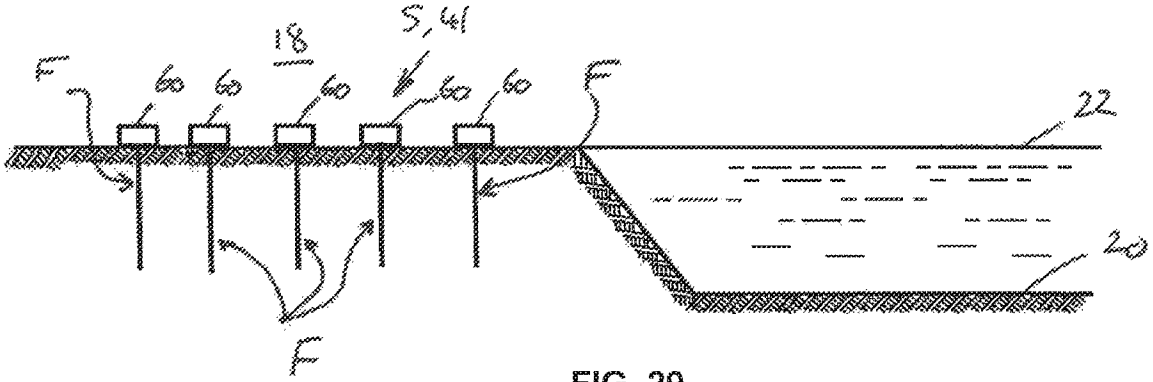
FIG. 29 is a side view of the support structure illustrated in FIG. 28.

In the embodiment illustrated in FIG. 27. the external LNG storage facility (68) is onshore. The advantage associated with this embodiment is that the onshore cryogenic storage facility can be constructed using well-established techniques for onshore LNG plant construction on a separate constriction schedule to the construction schedule associated with the support structure S and the subsequent installation of the plant module M. Advantageously, using this arrangement, other facilities associated with the LNG production plant (10) such as a maintenance facility (170), a utilities facility (172) for providing one or both of power and water, and an accommodation facility (174) may be located onshore. In this embodiment, the LNG transfer facility (72) extends from the onshore LNG storage facility (68) to a jetty (176) at which the LNG Carrier (74) berths to receive its cargo. The LNG transfer facility (72) includes a cryogenic pipeline (178) arranged on a bridge to minimise environmental impacts associated with the coastal modifications that might otherwise be associated with the use of a subsea cryogenic pipeline. Advantageously, the bridge may be configured to allow personnel to move between the onshore accommodation facility (174), the superstructure (12). and the LNG transfer facility (72).

Staying with FIG. 27, as will become apparent from the description of the onshore embodiments later in this specification. the LNG storage facility (68) and one or more of the maintenance facility (170), a utilities facility (172) and accommodation facilities (174) may be alternate forms of the plant module M which are transported by a HVL (V) and either skidded directly onto an onshore landing substructure, or floated over an offshore landing substructure then subsequently moved onshore. This may be considered as a hybrid embodiment of the LNG production plant (10) having some plant modules that are located offshore and some that are located on shore.

ONSHORE EMBODIMENTS

FIGS. 28-32 depict an onshore embodiment of the disclosed plant (10) which may be constructed utilising disclosed method (80). The substantive difference between the onshore embodiments and the offshore embodiments is that the support structure S is mainly or wholly located onshore. In particular in some embodiments a portion of the support structure S maybe offshore and a portion onshore, while in other embodiments the support structure S is entirely onshore.

In FIGS. 28-32 the entirety of the support structure S is located onshore. The support structure S in this embodiment comprises only the landing substructure (41) which is in the form of an array of footings F each having a support face (60). In this embodiment the method (80) of constructing the LNG production plant (10) is exactly the same as described above. Namely the plant module M is dry transported on a HLV (V) across the body of water (16) in accordance with this step (81). In step (83) the plant module M is transferred from the HLV (V) onto the support structure S without lifting the module M. Subsequently in step (83) the plant module M is arranged as, or to be part of, the LNG production plant (10) to facilitate the production and/or storage of LNG.

Figure 30:
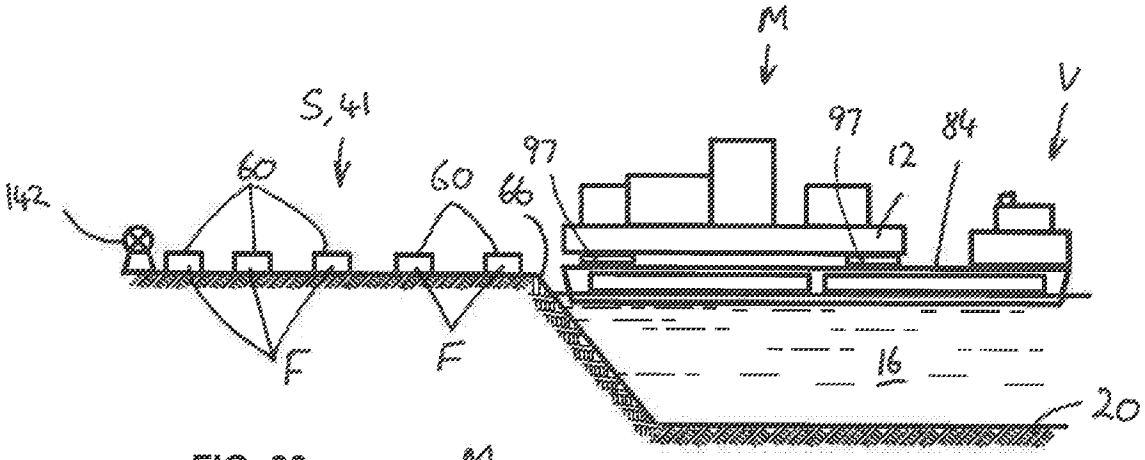
FIGS. 30-32 illustrated inside view a sequence of steps incorporated in the disclosed method for transferring a plant module and/or associated superstructure by a skid off operation onto the support structure shown in FIGS. 28 and 29.
Figure 31:
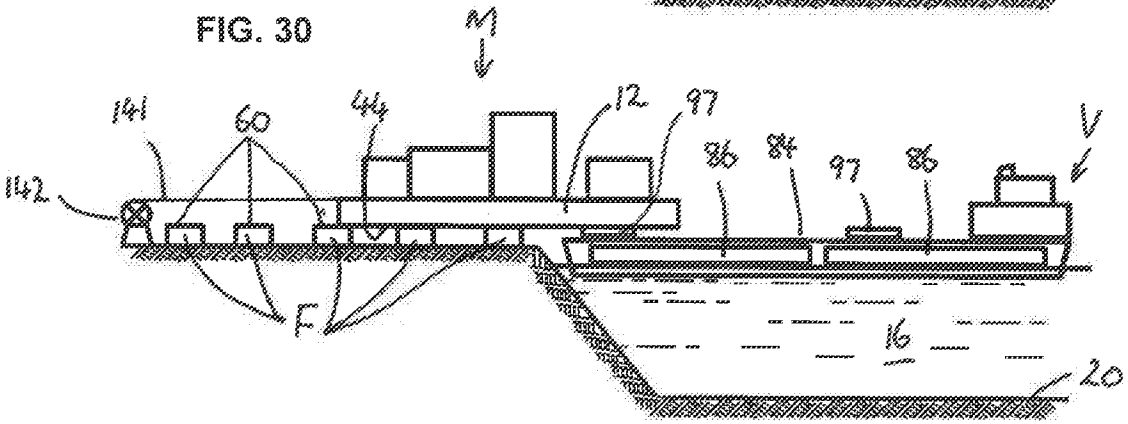

In the transfer step (83) instead of the float over operation as described in relation to the offshore embodiments the transfer is affected by a skid off operation. As shown in FIG. 30, the HLV (V) is moored adjacent to the shoreline (66) in substantive alignment with the support structure S. If necessary the buoyancy of the HLV (V) is adjusted using the ballasting system so that the support surfaces (44) of the plant module M are at substantially the same altitude as the support faces (60). A cable (141) wound on a winch system (142) is attached to the module M/superstructure (12), The winch (142) is operated to skid the module M off the deck of the HLV (V) and onto the faces (60) of the support structure S as shown progressively in FIGS. 30 and 31. The plant module M is then operated as or as part of the LNG production plant (10).

Figure 32:
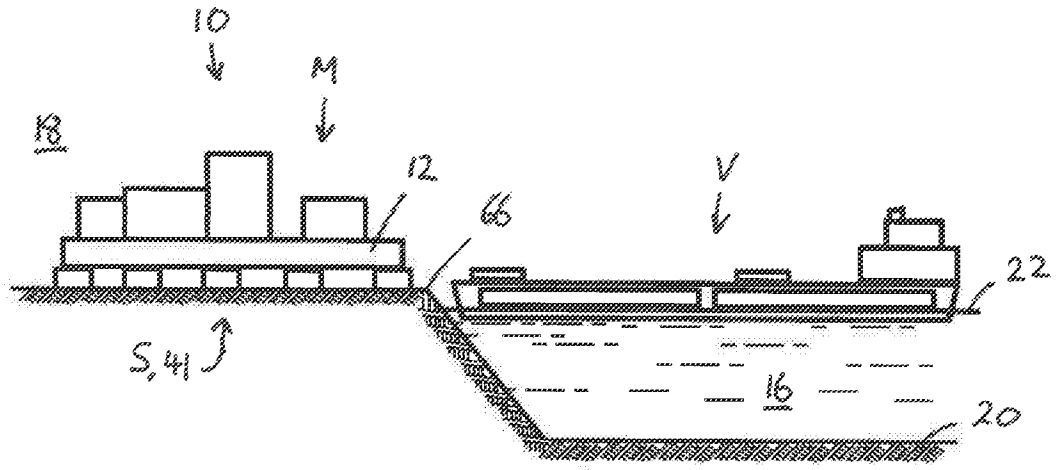
Figure 33:
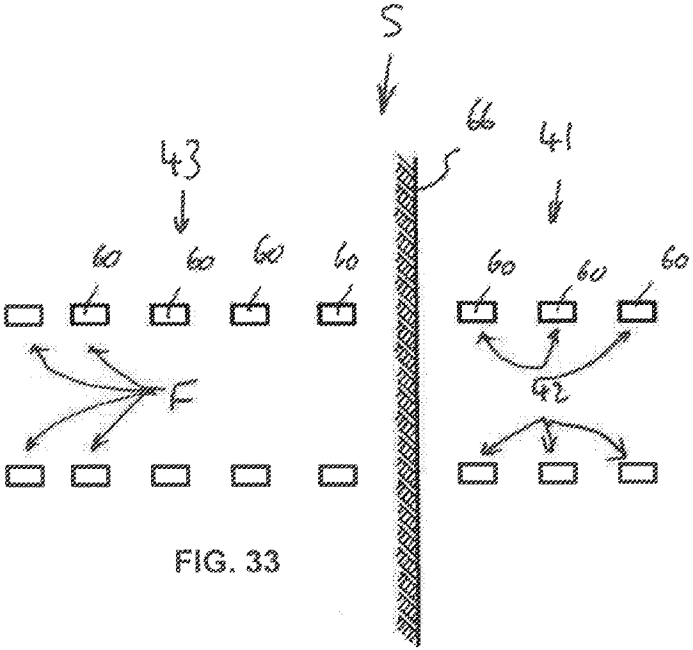
FIG. 33 is a plan view of a support structure incorporated in a further embodiment of the production plant in which a portion of the support structure, in the form of an onshore support substructure, is located offshore; and a portion of the support structure in the form of a landing substructure, is located onshore.
Figure 34:
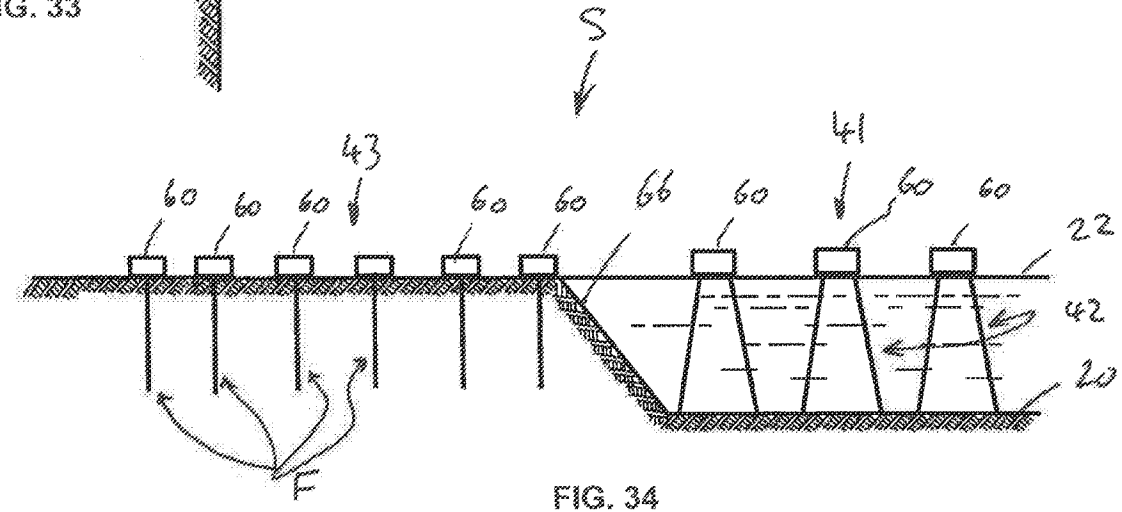
FIG. 34 is a side view of the support structure shown in FIG. 33.

FIGS. 33 and 34 show further forms of the support structure S which may be incorporated in other embodiments of the disclosed plant (10) and associated method (80). Here the support structure S comprises an offshore landing substructure (41) and an onshore support substructure (43). The landing substructure (41) may be in the form shown in FIGS. 2-5, i.e. an array of capped piles (42). The onshore landing substructure may be in the same form as the array of footings F shown in FIGS. 28-32, This form of support structure S enables the transfer of the module NI from the HLV (V) to he initially conducted by way of a float over operation onto the offshore landing substructure (41) in the same manner as described above in relation to the offshore embodiment depicted and described in relation to FIGS. 1-12. Once the plant module M is supported on the landing substructure (41) it can then be moved onto the onshore support substructure (43). This may be achieved in a variety of ways including but not limited to skidding the plant module M using a winch system (not shown) located at the distant end of the onshore support substructure (43).

Initially floating over the plant module M onto the landing substructure (41) may have benefits in comparison to skidding off the plant module M directly onto an onshore support structure S as described in relation to FIGS. 27-31. This is because wave and tidal action on the HLV (V) is less likely to cause difficulties in the transfer process.

In a further variation to this embodiment the plant module M maybe partially supported by both the onshore support substructure (43) and the offshore landing substructure (41) so that the module M spans the shoreline (66). This may be advantageous when the plant module M is a complete LNG train with no other plant module M being required for the LNG plant (10). In this instance there is a reasonable probability that the overall cost of construction of the support structure S will be minimised by having only enough capped piles (42) in the body of water (16) required to conduct a partial float over and subsequently skidding the plant module M so the front portion is supported on the onshore substructure (43).

In this transfer operation a front portion of the length of the plant module M is floated over the capped piles (42) and the ballasting system of the HLV (V) is operated so that the front portion of the plant module M is supported by surfaces the capped piles (42) while the remainder of the length of plant module M is simultaneously supported by the deck (84) of the HLV (V). Next a traverse system is used to move the plant module M further along the support structure S so that the front portion is supported on the onshore substructure (43) while a that portion of the plant module M supported on the capped piles (42) above the water plane (22). The traverse system may be simply one or more winches for skidding the plant module M. However as described further below other types of traverse systems may be used for moving the plant module M once landed on the landing substructure (41).

Figure 35:
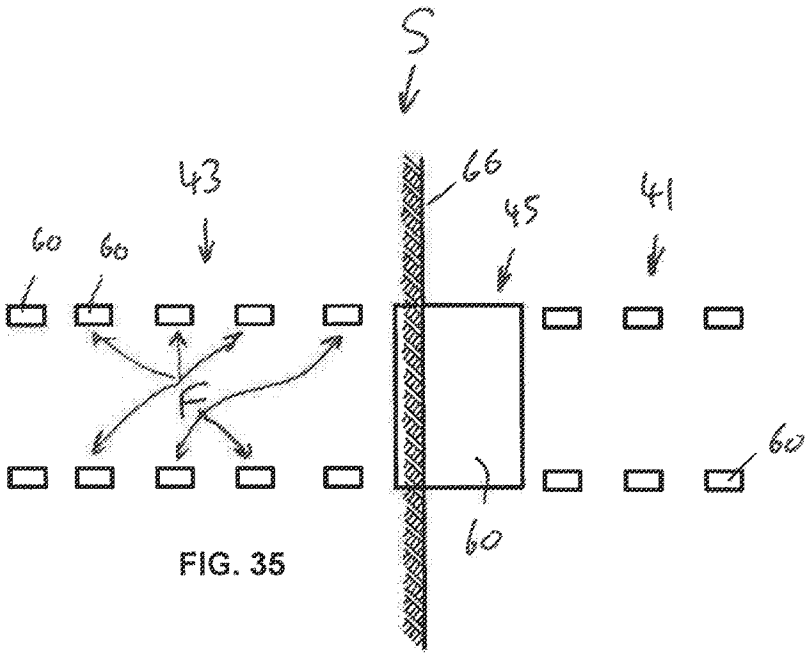
FIG. 35 is a plan view of a support structure incorporated in yet another embodiment of the disclosed production plant in which the support structure comprises an onshore support substructure, an offshore landing substructure, and a bridge portion that spans a shoreline between the substructures.
Figure 36:
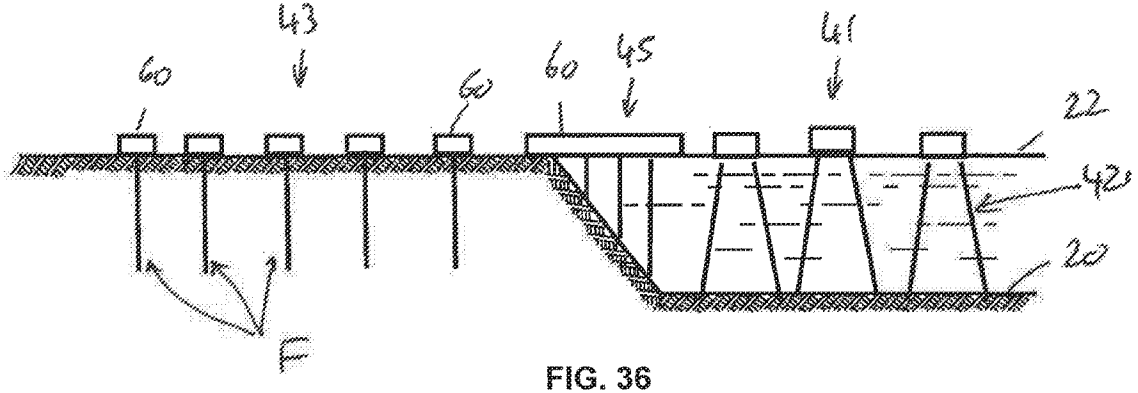
FIG. 36 is a plan view of the support structure shown in FIG. 35.

FIGS. 35 and 36 depict a further variation in which the support structure S comprises the landing substructure (41) the onshore support substructure (43) and an intervening bridge (45). When using the method (80) to construct the LNG production plant (10) and plant module M can be floated over or skidded off the HLV (V) onto the landing substructure (41) then traversed onto and across the bridge (41) and subsequently wholly (or indeed partially) onto the onshore substructure (43) using an appropriate traverse system.

The onshore support substructure (43) shown in FIGS. 35 and 36 comprises a plurality of footings F on which a plant module M/superstructure (12) bears. However the support substructure (43) may take other forms such as a plinth or simply compacted ground.

Figure 37:
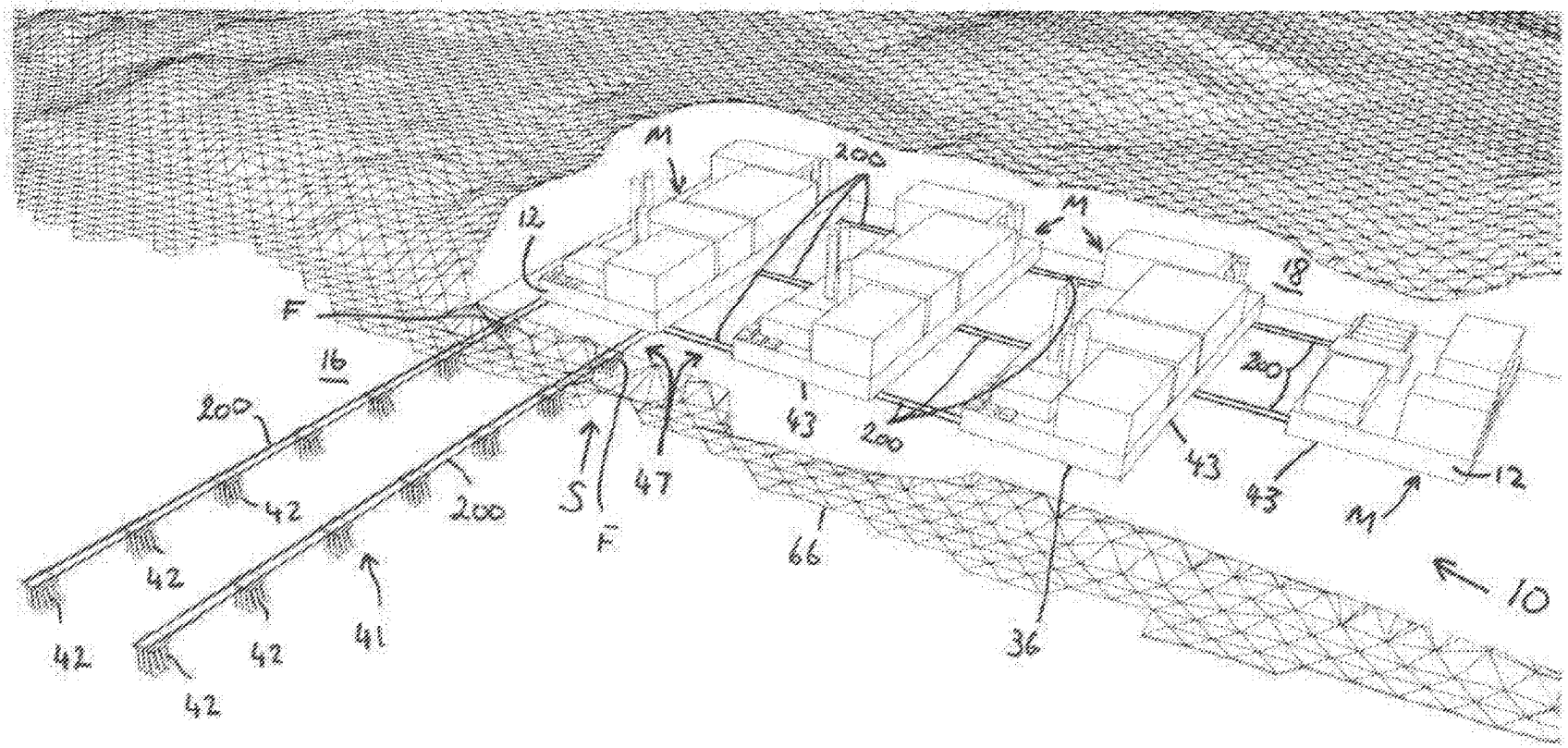
FIG. 37 is a schematic representation of the disclosed LNG production plant which incorporates a support structure having a plurality of onshore substructures, an offshore landing substructure, and a transport path enabling transport of multiple plant modules from the offshore landing substructure to a designated onshore support substructure.

FIG. 37 depicts a further embodiment of the LNG production plant (10) at an onshore production location (18). The location (18) is a nearshore location having a shoreline (66) which delineates the land from a body of water (16), The LNG production plant (10) comprises a plurality of plant modules M with the associated support structure S comprising in combination: a predominantly offshore landing substructure (41); a plurality of onshore support substructures (43): and a transport path (47). The transport path (47) is provided with a change in direction so that the plant modules M can be initially moved parallel to and off of the landing substructure (41) and subsequently onto laterally offset onshore support substructures (43), The landing, substructure (41) is in the form of an array of off shore capped piles (42) disposed in the body of water (16) and a pair of footings F on land in alignment with the capped piles (42), The onshore support substructures (43) may be in the form of plinths or otherwise stabilised and/or compact at ground. (The support substructures (43) are underneath the respective plant modules M.)

In this particular embodiment of the transport path (47) comprises a plurality of rails or tracks (200). A first length of the tracks (200) extends along the landing substructure (41). Second lengths of the track (200) run perpendicular to the first length and across the onshore support substructures (43).

The contact surfaces (not visible in this Figure) of the plant modules M may be in various forms in order to run along the rails or tracks (200). For example the contact surfaces may be in the form of skid shoes that simply skid along tracks (200), This skidding may be affected by pulling or pushing a plant module M using a traverse system in the form of, for example: a winch system; or, a prime mover such as a tractor. Alternatively the traverse system may comprise hydraulic jacks provided on or in the superstructure (12) of a plant module M to facilitate moving the plant module M by skidding or otherwise to a designated onshore support substructure (43).

In yet a further alternative the contact surfaces may be in the form of wheels that amounted to the superstructure (12). The wheels can be supported on retractable struts or axles which are constructed as part of the plant modules NI/superstructure (12) and selectively extended to engage the tracks (200) and lift the superstructure base (36) from the tracks (200). The wheels may also be steerable so as to follow a turn or bend in the transport path (47).

In the event that wheels are used as the contact surfaces winches or a tractor to affect rolling movement of a corresponding plant module M. Alternately the traverse system may include a motor in or on the superstructure (12) to impart torque to the wheels. The motor maybe provided with power from an external power source; or an on-board power source, for example a diesel engine that may he incorporated into the plant module M/superstructure (12). In the latter instance the traverse system is in effect a prime mover incorporated within the plant module M enabling the plant module M to be self-movable and driveable. As a further alternative to wheels the contact surfaces (44) can be in the form of a continuous track for example as provided on the military tanks and heavy earthmoving equipment, Where a plant module M/superstructure (12) is provided with wheels or a continuous track then the transport path (47) may be in the form of a road.

In the LNG production plant (10) shown in FIG. 37 three of the plant modules M may each constitute complete LNG trains while the fourth of the plant modules shown on the left-hand side may be in the form a utilities module having for example power generation plant and auxiliary equipment. Additionally although not shown one or more plant modules in the form of LGN storage tanks may be transported and transferred to respective support substructures (43). Separately or in further addition, as previously described some of the plant modules M may have their own internal fluid storage tanks that may supplement the dedicated LNG storage modules. In yet a further alternative where some of the plant modules M have their own internal fluid storage tanks the tanks may be plumbed together to provide cryogenic storage for LNG produced by the plant (10).

Figure 38:
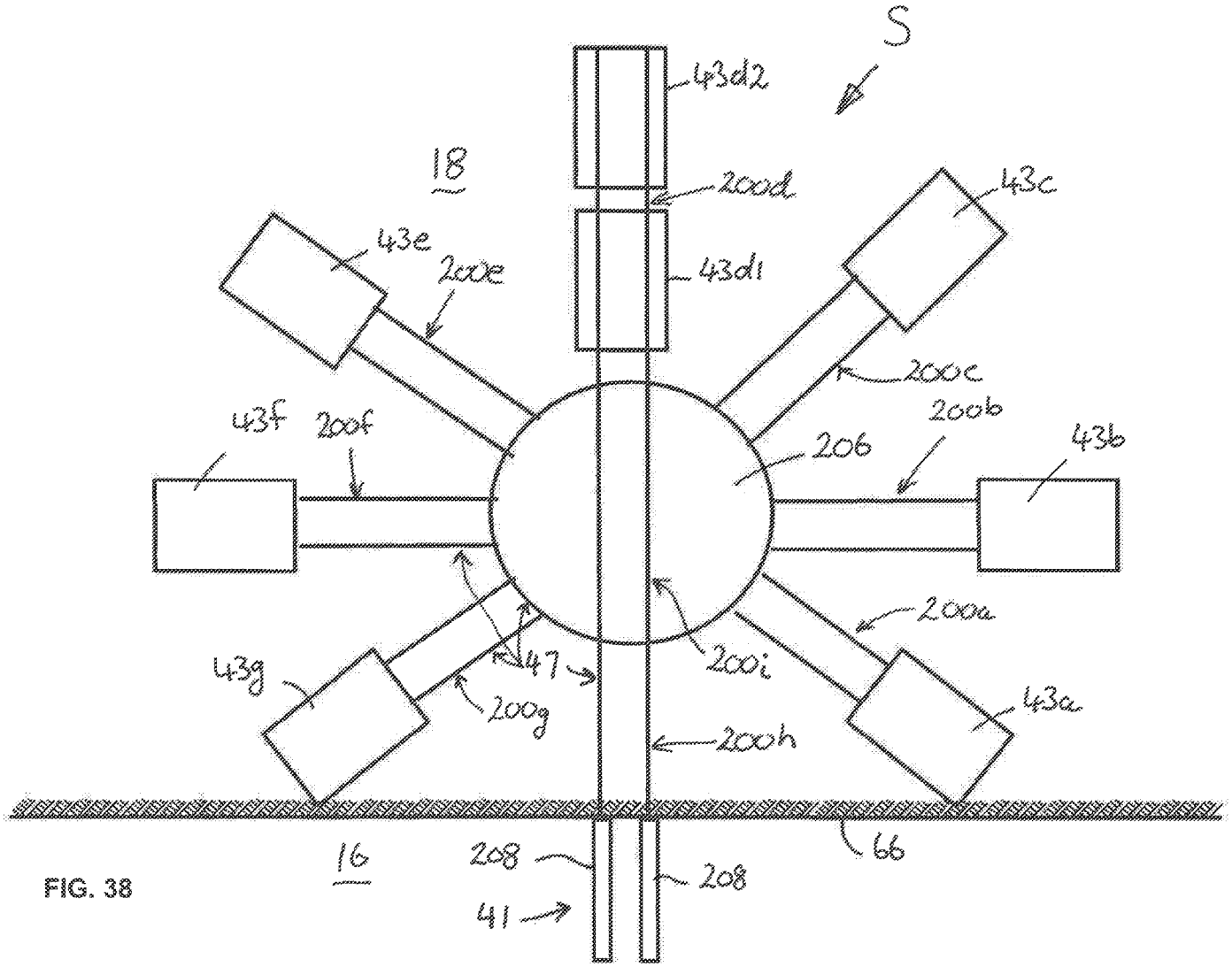
FIG. 38 is a schematic representation of a support structure incorporated in a further embodiment of the disclosed LNG production plant in which the support structure has an offshore landing substructure, a plurality of onshore support substructures and a transport path provided with a turntable and a number of rails radiating from the turntable enabling a change in direction of movement of a plant module from the landing substructure to a non-aligned onshore support substructure.

FIG. 38 provides a schematic representation of a support structure S that may be incorporated in yet a further embodiment of the disclosed LNG production plant. The support structure S comprises an offshore landing substructure (41), a plurality of onshore support substructures (43*a*, 43*b*, 43*c*, 43*d*1, 43*d*2, 43*e*, 43*f* and 43*g*) hereinafter referred to in general as "onshore support substructures (43*x*)" and a transport path (47) along which a plant module can be moved from the landing substructure (41) to a selected onshore support substructure (43). The transport path (47) comprises a turntable (206) and a number of tracks (200*a*-200*g*) hereinafter referred to in general as "tracks (200*x*)" radiating from a periphery of the turntable (206). Each track (200*x*) extends from the turntable (206) to a corresponding onshore production substructures (43*x*).

Each onshore production substructure (43*x*) is able to accommodate a corresponding plant module. When constructing the production plant using the support structure S, plant modules M are transferred by a heavy lift vessel (V) across the body of water (16) to the landing substructure (41). Plant modules M may then be transferred onto the landing substructure (41) by way of a float over, skidding, or a combination of both. Once a plant module M is on the landing substructure (41) a traverse system operates to move the plant module in one direction along the track (200*h*) and onto the track (200*i*) on the turntable (206). Except for the case where the destination of the plant module M is the substructure (43*d*2) or (43*d*1), the turntable (206) is turned to rotate the plant module so that the track (200*i*) aligns with the track (200*x*) leading to the destination substructure (43*x*) for that plant module. The plant module can now be moved in a second direction which is different to the first direction to its destination onshore substructure (43*x*).

The support structure S shown in FIG. 38 is able to accommodate eight plant modules, one on each of the onshore production substructures (43*x*). The number of onshore substructures (43*x*) can be increased by providing multiple onshore substructures (43*x*) behind each other as shown in relation to the substructures (43*d*2) and (43*d*1).

In the embodiment shown in FIG. 38 the landing substructure (41) is different to that shown in early embodiments by virtue of the landing substructure (41) comprising a pair of parallel spaced apart beams (208) is supported on piles (not shown) driven into the floor of body of water (16). However the landing substructure (41) of course can be in the same form as that shown for example in FIGS. 4 and 5. Further, while the landing substructure (41) is illustrated in FIG. 38 is being offshore it could be located wholly onshore at the production location (18). In that instance the transfer of plant modules from a heavy lift vessel (V) via a skid off operation.

Figure 39:
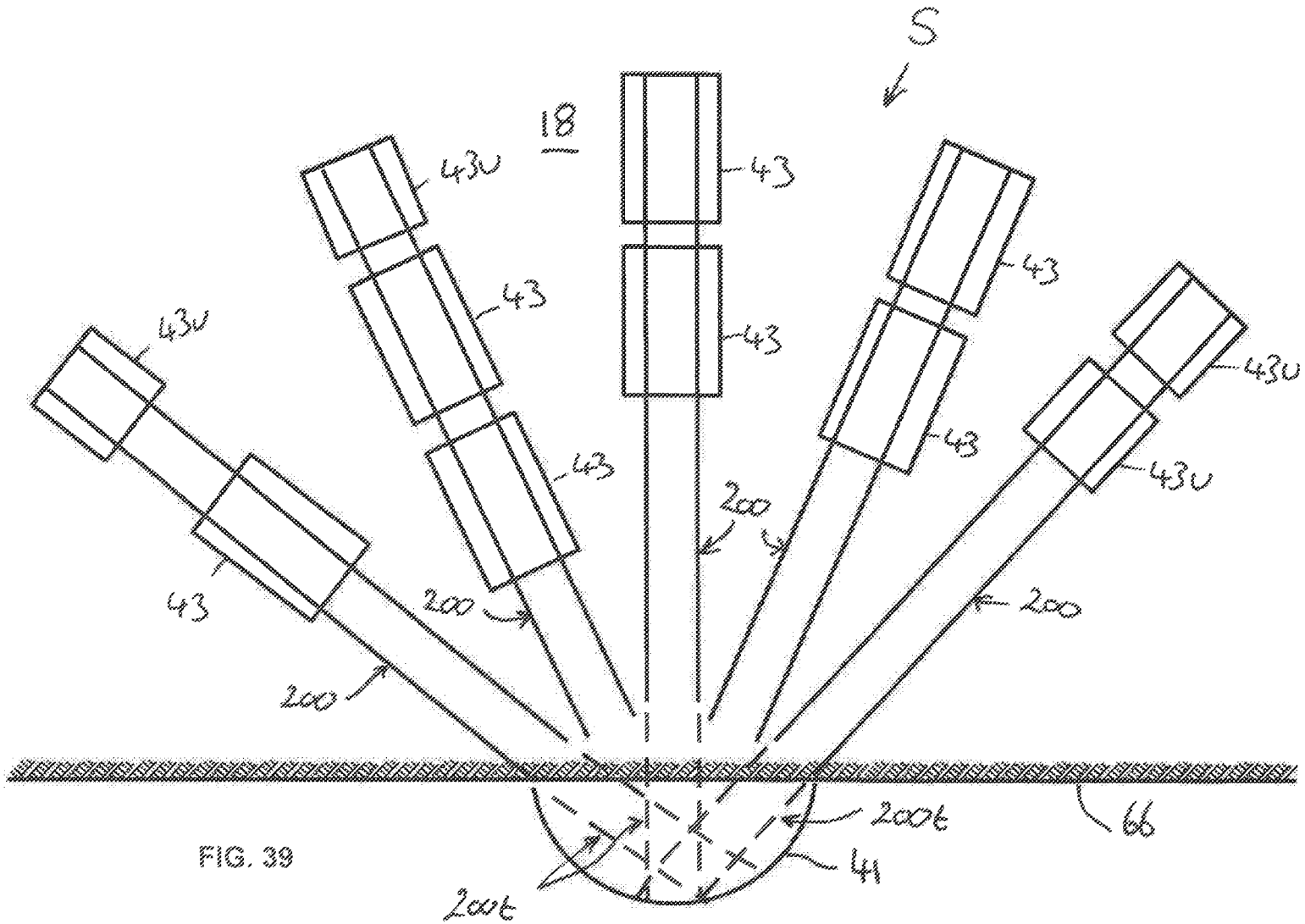
FIG. 39 is a schematic representation of a support structure incorporated in yet a further embodiment of the disclosed. LNG production plant in which the support structure has hemi-elliptical landing substructure, a plurality of onshore support substructures of two different configurations and a number of track radiating in different directions from the landing substructure to the onshore support substructures.

FIG. 39 is a schematic representation of a support structure S that may be incorporated in yet a further embodiment of the disclosed LNG production plant (10). The support structure S comprises an offshore landing substructure (41). a plurality of onshore support substructures (43, 43*u*) and a transport path (47) along which a plant module can be moved from the landing substructure (41) to a selected onshore support substructure (43). The landing substructure (41) is of a hemi-elliptical configuration and may be supported by one or more offshore piles. The transport path (47) has one or more transition tracks (200*t*) (three shown only in order to reduce complexity of the Figure) and tracks (200) along which the support substructures (43, 43*u*) are located. The one or more transition tracks (200*t*) extend from the offshore landing substructure (41) to a corresponding track (200). In one embodiment there may be only a single transition track (200*t*) which can be moved to align with any particular track (200). Alternatively there may be a transition track 200*t*) for each track (200). The support substructures (43) and (43*u*) are disposed on the tracks (200) and are of different size to each other to accommodate different sized plant modules, for example a utilities plant module may be disposed on the support structure (43*u*), while a plant module in for example the form of a complete LNG train or a liquefaction facility may be located on the support structure (43).

In this embodiment a heavy lift vessel (which may optionally be provided with an outrigger) is aligned about the periphery of the offshore landing substructure (41) with a particular track (200) having a designated destination onshore support substructure (43, 43*u*) for a transported plant module. If a dedicated transition track (200*t*) is not provided for each of the tracks (200) then a movable transition track (200*t*) is installed on the landing substructure (41) in alignment with the heavy lift vessel and the track (200) to facilitate the transfer of the plant module from a heavy lift vessel onto the structure S and subsequent movement of the plant module to its designated onshore landing substructure (43, 43*u*).

Referring back to FIG. 37 in yet a further variation the support structure S can he provided with a plurality of landing substructures (41) each of which is in alignment with a corresponding onshore support substructure (43). In this variation the transport path (47) may comprise simply a plurality of straight tracks or rails (200) that extend directly from a landing substructure (41) to a corresponding onshore support substructure (43). This avoids the need to construct a transport path (47) which has one or more bends or changes of direction as well as avoiding the need to arrange contact surfaces (44) on the plant modules M that facilitate the following of a bend or a change in direction. However it will be recognised that this variation will incur additional construction cost as a plurality of offshore landing substructures (41) are required.

HYBRID ONSHORE/OFFSHORE EMBODIMENT

As will be readily apparent to those of ordinary skill in the art, the above-described onshore and offshore embodiments of the LNG production plant (10) and associated construction method (80) may be incorporated to construct a plant (10) having one or more plant modules NI onshore and one or plant modules offshore. Such an embodiment may also include a plant module M that spans the shoreline (66) so that one part of that plant module M is onshore while another part of the same plant module M is offshore. For example with reference to FIGS. 33 and 34 an LNG production plant (10) may be constructed which comprises the support structure S having an offshore landing substructure (41) and an onshore support substructure (43) with one plant module M supported on the substructure (41) and another supported on the substructure (43). These plant modules M may then be coupled together to form either an entire, or a part of, LNG production plant.

Various embodiments of the production plant and associated method of construction disclosed provide at least the following advantages over the prior art:

a) The plant modules M can be constructed at a construction location remote from the plant location (18) and then dry transported by a heavy lift vessel V to the plant location (18). This greatly reduces costs compared to traditional onshore construction and allows for testing and commissioning of the LNG production facilities to be done prior to installation.

b) The plant modules M may be construed for many particular process or combination of processes involved in the production and storage of LNG. This includes constructing a plant module M as a standalone LNG tank or storage vessel. However as explained above in some embodiments for example are shown in FIGS. 1-12 a separate gravity based LNG storage facility may be installed in the production plant (10) instead of a plant module based LNG storage facility.

c) Using, embodiments of the disclosed LNG production plant (10) and associated method of construction (80) may result in substantial savings in the overall operation of the process at maximum capacity and provides for great ease in expanding the process incrementally in comparison to stick built LNG production plants and various geographical locations around the world.

d) Embodiments of the disclosed production plant (10) and method (80) provides a near-shore LNG production plant option that is expandable in terms of capacity in a manner that is not possible using prior art 'floating LNG' options which rely on the deck space being fully occupied with processing equipment.

e) In embodiments where the plant module M is solely the superstructure (12) it is possible to stick built the required plant on the superstructure (12) once on the support structure S which may expand competition and flexibility and contracting strategy.

f) Integration of multiple LNG trains is enhanced due to hard pipes for interconnections to facilitate utilisation of common facilities (e.g. flares, power and other utilities, storage etc).

Now that several embodiments of the disclosed LNG production plant and method have been described in detail, it will be apparent to persons skilled in the relevant art the plant and method may be embodied in many other forms. For example the winch system (142) and motors/power sources incorporated in the plant modules NI to facilitate movement along the transport path (47) may be considered as traverse systems of the plant (10). In the case of the winch system (142) the traverse system is external to the plant modules M. An alternative form traverse system may comprise one or more bogeys carriages that may run in or on the transport path (47) and on which the plant modules M and/or superstructures (12) are carried.

Figure 4:
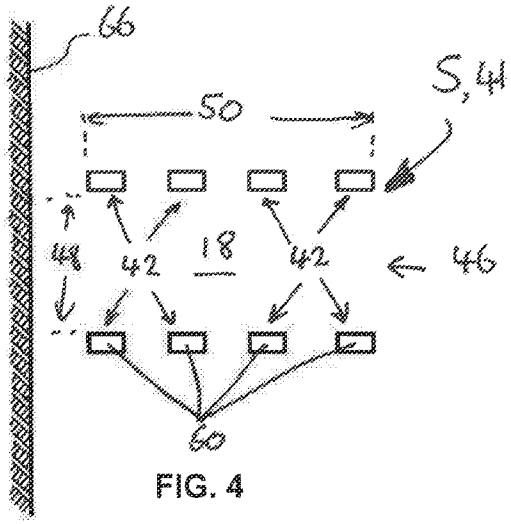
FIG. 4 is a schematic plan view of the support structure incorporated in the embodiment of the production plant illustrating FIG. 1.
Figure 5:
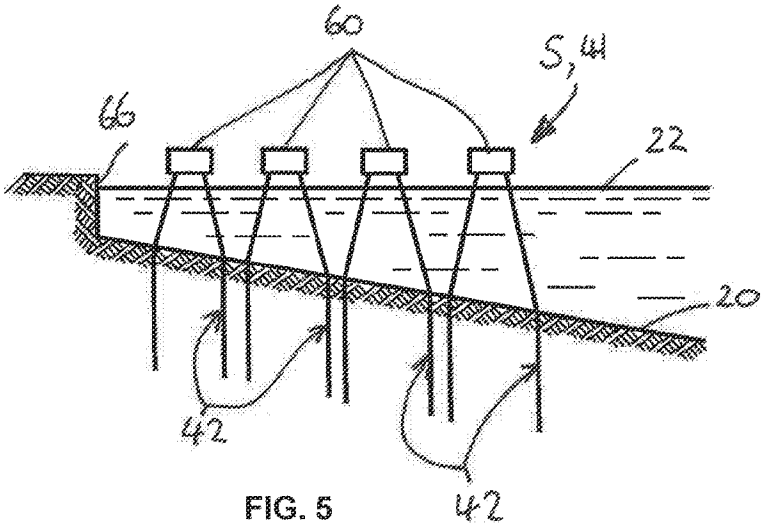
FIG. 5 is a schematic side view of support structure in FIG. 4.
Figure 7:
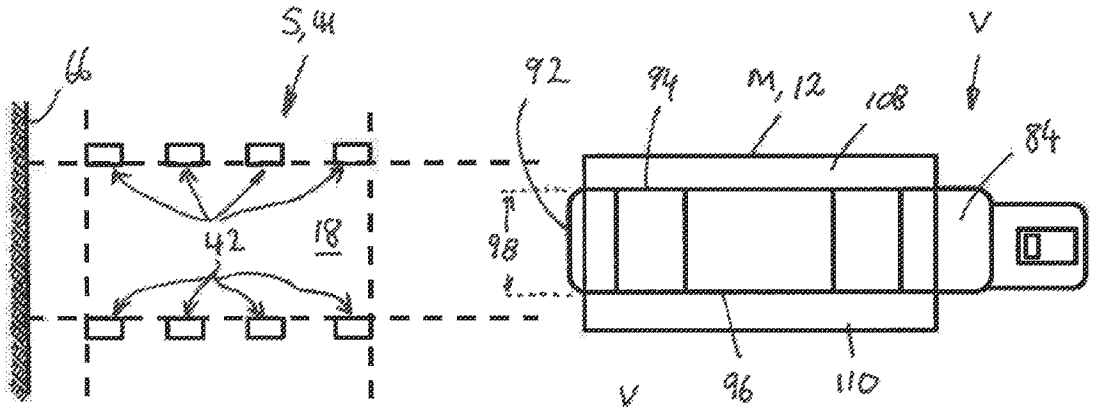
FIGS. 7 to 9 sequentially illustrate a subset of steps in the method shown in FIG. 6 for transferring, by way of float over, a plant module from a heavy lift vessel to the support structure shown in FIGS. 4 and 5.
Figure 8:
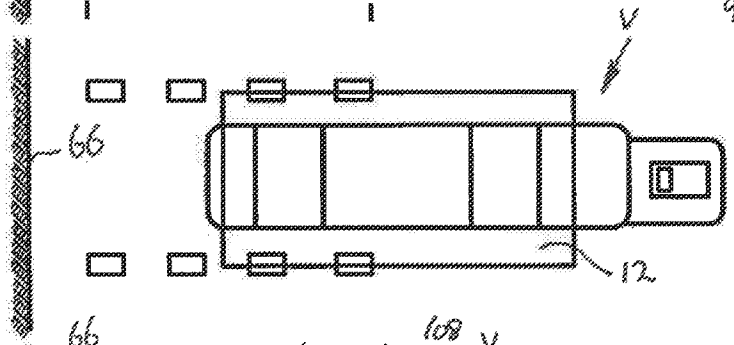
Figure 9:
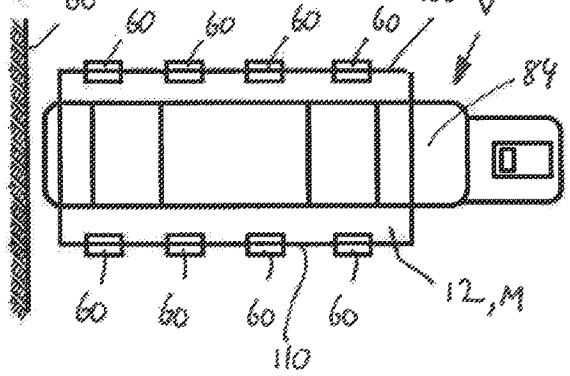
Figure 10:
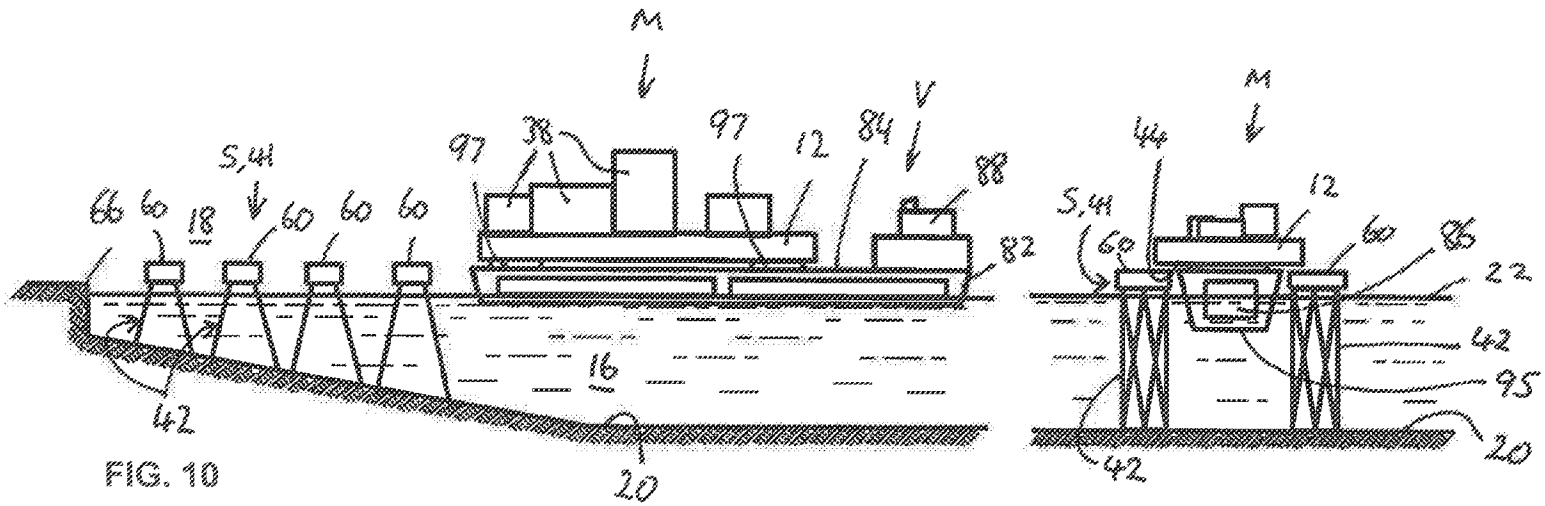
FIGS. 10 to 12 sequentially illustrate in side view the float over of a plant module from a heavy lift vessel to the support structure.
Figure 11:
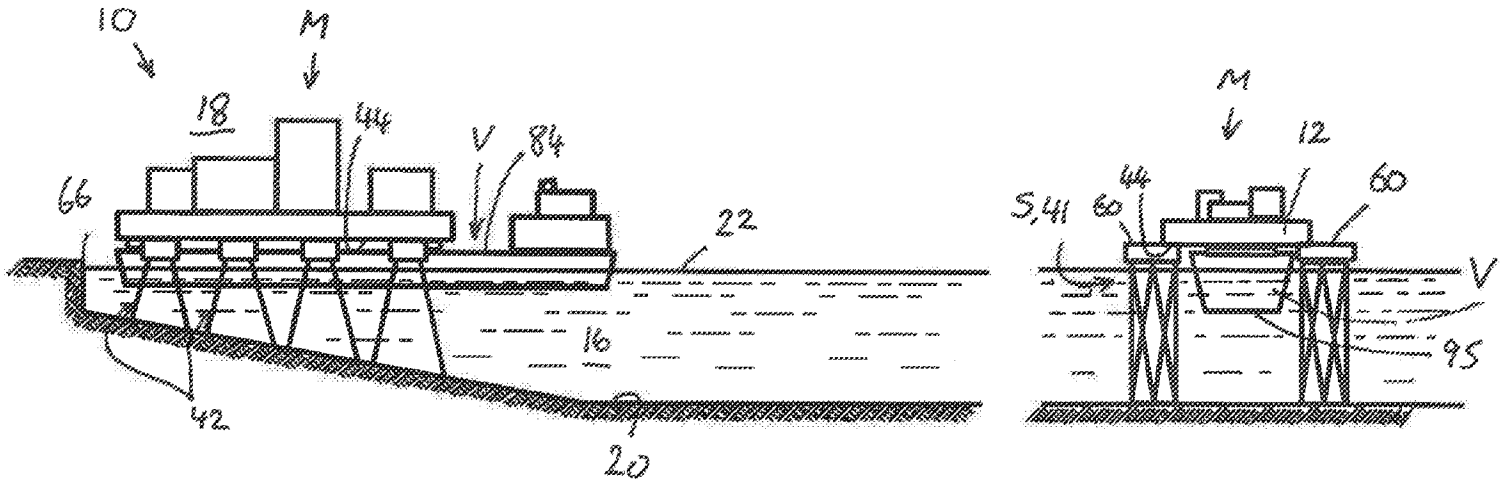

With reference to the embodiments shown in FIGS. 1-12 it should be understood that in other variations it is possible for the LNG production plants to be expanded to include more than one module. With particular reference to FIG. 4, in one example, this may be done by simply dimensioning the array length (50) sufficient so accommodate two or more modules which are aligned in an end to end orientation. In another example which requires a fewer number of capped piles, an additional row capped piles may be installed parallel to and coterminous with the two rows of capped piles (42) shown in FIG. 4, This provides for two plant modules to be installed side-by-side to form an LNG production plant. In such a variation the intermediate of capped piles may be engineered to carry a heavier load and have a greater support surface (60) area than the outer rows of capped piles (42).

Also, it should be understood that the array width (48) need only be greater than the beam of the HLV (V) when a plant module is transferred onto the corresponding support structure (41) by a float over operation. If the transfer is by a skid off operation the HLV (V) may not be able to sail in between rows of the capped piles (42).

In a further embodiment, the disclosed LNG production plant (10) may comprise one or more plant modules M such as a liquefaction module or complete LNG train that is transferred from a HLV (V) and installed on an onshore support substructure (43) in combination with either an offshore LNG storage facility provided as a gravity based structure ("GBS"), or an offshore floating LNG storage facility. Such an embodiment of a LNG production plant may for example have a configuration of the plant module M supported on the onshore support structure 41 as shown in FIG. 32 but coupled to a gravity-based LNG storage facility (68) such as a depicted in FIG. 2, or a floating LNG storage facility (68) as depicted in FIG. 25*c*. In such an embodiment the offshore LNG storage facility can be either wet towed or dry towed to the LNG production plant location, As in the previously described embodiments a LNG storage, facility (68) includes an LNG transfer facility for conducting the stored LNG to a LNG carrier.

The various aspects of the disclosed plant and method can he included in combination with each other to produce further embodiments, as would be understood by those with ordinary skill in the art, given the understanding provided herein. Also, various aspects of the embodiments could be used in conjunction with each other to accomplish the understood goals of the disclosed plant and method. Also, the directions such as "top", "bottom", "upper". "lower", and other directions and orientations are described herein for clarity in reference to the figures and are not to be limiting of the actual device or system or use of the device or system. Unless the context requires otherwise, the word "comprise" or variations such as "comprises" or "comprising", should be understood to imply the inclusion of at least the stated element or step or group of elements or steps or equivalents thereof, and not the exclusion of a greater numerical quantity or any other element or step or group of elements or steps or equivalents thereof. Further, the order of steps can occur in a variety of sequences unless otherwise specifically limited, The various steps described herein can be combined with other steps, interlineated with the stated steps, and/or split into multiple steps.

What is claimed:

1. A method of constructing a LNG production plant comprising the steps of:

dry transporting on a heavy lift vessel a plant module across a body of water;

transferring from the heavy lift vessel the plant module onto a structure arranged to support the plant module at a fixed altitude, wherein the structure is at least partially located onshore and leads to or constitutes an onshore support substructure for supporting the plant module and wherein the transferring is performed without lifting the module; and arranging the plant module as, or as a part of, the LNG production plant to facilitate the production and/or storage of LNG.

2. The method according to claim 1, wherein the transferring comprises for at least a period of time supporting the plant module simultaneously on both the structure and a deck of the heavy lift vessel.

3. The method according to claim 1, wherein the transferring comprises adjusting buoyance of the vessel so that each of one or more contact surfaces of the plant module lie at an altitude substantially flush with an altitude of a support surface of the structure.

4. The method according to claim 1 wherein transferring comprises:

floating over of the plant module by the heavy lift vessel directly onto the structure; skidding the module off the heavy lift vessel; and driving the plant module off the heavy lift vessel, pushing the plant module off the vessel or pulling the plant module off the heavy lift vessel.

5. The method according to claim 4, wherein the transferring comprises a combination of:

floating over the plant module by the heavy lift vessel and subsequently skidding the plant module across the structure; or floating over the plant module by the heavy lift vessel onto the structure and subsequently driving the plant module across the structure.

6. The method according to claim 1, further comprising installing the structure near a shoreline defining a boundary between an onshore location and an offshore location in the body of water adjacent to the onshore location.

7. The method according to claim 6, wherein the structure is located wholly onshore and transferring comprises skidding, driving or pushing the module off the heavy lift vessel onto the structure.

8. The method according, to claim 6, wherein installing the structure comprises installing the structure as a ground founded landing substructure onto which the plant module is transferred from the heavy lift vessel.

9. The method according to claim 6, wherein installing the structure comprises installing one or more onshore support substructures at respective onshore locations and constructing a transport path between the landing substructure and one or more onshore support substructures.

10. The method according, to claim 9, further comprising moving the plant module across or along the transfer path from the landing substructure to the one or more onshore support substructures.

11. The method according to claim 10, wherein moving the LNG structure comprises at least one selected from the group consisting of skidding, pulling, pushing and driving the plant module across or along the transport path.

12. The method according to claim 9, wherein constructing the transport path comprise laying one or more rails, tracks or roads.

13. The method according to claim 9, further comprising configuring the transport path to have at least one change in direction or to facilitate a change in direction of motion of a plant module from the landing structure to an onshore support substructure.

14. The method according to claim 9, further comprising constructing the transport path comprises installing a turntable capable of receiving a plant module being moved in one direction and rotating the plant module to enable further movement of the plant module in a second different direction.

15. The method according to claim 1, wherein transferring comprises initially floating over of the plant module by the heavy lift vessel directly onto an offshore portion of the structure and subsequently skidding, driving or pushing the module off the heavy lift vessel from the offshore portion of the structure along an onshore potion of the structure to the onshore location.

16. The method according to claim 1, further comprising constructing the plant module as:

a superstructure on or in which plant and equipment for performing or supporting a process step in the production of LNG can be mounted or installed the superstructure being dimensioned to facilitate transfer from the heavy lift vessel to the support structure;

a complete LNG train which includes: a superstructure dimensioned to facilitate transfer from a heavy lift vessel to the support structure and plant and equipment mounted on a deck of the superstructure required for the pre-treatment of a LNG feed stream and subsequent liquefaction to produce LNG;

a pre-treatment module which includes the superstructure dimensioned to facilitate transfer from a heavy lift vessel to the support structure and plant and equipment mounted on the deck of a superstructure to produce a pre-treated natural gas stream;

a first refrigerant compression module which includes a superstructure dimensioned to facilitate transfer from a heavy lift vessel to the support structure and plant and equipment mounted on a deck of the superstructure to provide compression of a refrigerant, a first refrigerant condenser module which includes a superstructure dimensioned to facilitate transfer from a heavy lift vessel to the support structure and plant and equipment mounted on a deck of the superstructure to condense a refrigerant;

a liquefaction facility which includes a superstructure dimensioned to facilitate transfer from a heavy lift vessel to the support structure and plant and equipment mounted on a deck of the superstructure to liquefy a vapour;

a second refrigerant compression module which includes a superstructure and plant and equipment on the superstructure to perform compression of a second refrigerant, for example the second refrigerant compression module may be a mixed refrigerant (MR) compression module;

a utilities module which includes plant, facilities or equipment for one or a combination of two or more of: power generation, condensate stabilisation, MEG regeneration, drinking and service water and firefighting;

storage tanks for holding LNG or other fluids wherein the tanks comprise or are disposed in a superstructure dimensioned to facilitate transfer from a heavy lift vessel to the support structure.

17. The method according to claim 1, wherein the dry transporting is performed on two or more occasions to transport two or more plant modules to the structure.

18. The method according to claim 1, further comprising, when the plant module is a complete LNG train or a LNG liquefaction facility, transporting at least one LNG storage facility to the LNG production plant and connecting the at least one LNG train or LNG liquefaction facility to the LNG storage facility.

19. The method according to claim 18, wherein the LNG storage facility is in the form of a plant module, dry transported by a heavy lift vessel and transferred onto the support structure.

20. The method according to claim 18, wherein the LNG storage facility is provided in the form of a gravity-based structure or a floating structure, and is dry towed or wet towed to the LNG production plant.

21. A LNG production plant comprising:

one or more a dry transportable plant modules;

a support structure having a fixed altitude and configured to receive the one or more plant modules transferred from a heavy lift vessel without one or more the plant modules being lifted from a deck of the heavy lift vessel, the support structure having at least a portion located onshore that leads to or constitutes an onshore support substructure for supporting the plant module, the support structure further arranged to support the one or more plant modules when the one or more plant modules constitute, or are coupled together to form, the LNG production plant.

22. The LNG production plant according to claim 21, wherein the support structure is configured so that a plant module being transferred from the heavy lift vessel to the support structure is able to be supported by both the support structure and a deck of the vessel simultaneously for a period of time during the transfer.

23. The LNG production plant according to claim 21, wherein the one or more plant modules comprise one or more of:

a superstructure on or in which plant and equipment for performing or supporting a process step in the production of LNG can be mounted or installed, the superstructure being dimensioned to facilitate transfer from the heavy lift vessel to the support structure;

a complete LNG train which includes: a superstructure dimensioned to facilitate transfer from a heavy lift vessel to the support structure and plant and equipment mounted on a deck of the superstructure required for the pre-treatment of a LNG feed stream and subsequent liquefaction to produce LNG;

a pre-treatment module which includes the superstructure dimensioned to facilitate transfer from a heavy lift vessel to the support structure and plant and equipment mounted on the deck of a superstructure to produce a pre-treated natural gas stream;

a first refrigerant compression module which includes a superstructure dimensioned to facilitate transfer from a heavy lift vessel to the support structure and plant and equipment mounted on a deck of the superstructure to provide compression of a refrigerant;

a first refrigerant condenser module which includes a superstructure dimensioned to facilitate transfer from a heavy lift vessel to the support structure and plant and equipment mounted on a deck of the superstructure to condense a refrigerant;

a liquefaction facility which includes a superstructure dimensioned to facilitate transfer from a heavy lift vessel to the support structure and plant and equipment mounted on a deck of the superstructure to liquefy a vapour;

a second refrigerant compression module which includes a superstructure and plant and equipment on the superstructure to perform compression of a second refrigerant, for example the second refrigerant compression module may be a mixed refrigerant (MR) compression module;

a utilities module which includes plant, facilities or equipment for one or a combination of two or more of: power generation, condensate stabilisation, MEG regeneration, drinking and service water and firefighting; or storage tanks for holding LNG or other fluids wherein the tanks comprise or are disposed in a superstructure dimensioned to facilitate transfer from a heavy lift vessel to the support structure.

24. The LNG production plant according to claim 23, wherein the superstructure comprises a prismatic boxlike structure or an open frame structure.

25. The LNG production plant according to claim 21, wherein the support structure is configured to support a plant module at a location so that the plant module spans a shoreline and lies partially onshore and partially offshore.

26. The LNG production plant according to claim 21, wherein the support structure is configured to support a plant module wholly onshore.

27. The LNG production plant according to claim 21, wherein the support structure comprises a landing substructure onto which the one or more plant modules is directly transferred from the heavy lift vessel.

28. The LNG production plant according to claim 27, wherein the support structure comprises one or more onshore production substructures and a transport path between the landing substructure and the one or more onshore production substructures wherein the one or more plant modules is able to traverse the transport path to facilitate moving of the one or more plant modules from the landing substructure to the one more onshore production substructures.

29. The LNG production plant according to claim 28, wherein the transport path comprises one or more rails, tracks or roads.

30. The LNG production plant according to claim 28, wherein the transport path is configured to have at least one change in direction.

31. The LNG production plant according to claim 28, wherein the transport path comprises a turntable capable of supporting a plant module and turning the plant module to facilitate the at least one change in direction.

32. The LNG production plant according to claim 28, further comprising a traverse system capable of traversing respective plant modules along the transport path.

33. The LNG production plant according to claim 32, wherein a respective traverse system is incorporated in each of the one or more plant modules.

34. The LNG production plant according to claim 32, wherein the traverse system is separate to the one or more plant modules.

35. The LNG production plant according to claim 21, wherein:

at least one plant module is arranged as a complete LNG train or a liquefaction facility and wherein the support structure for the plant module is onshore; and at least one LNG storage facility located offshore for storing LNG produced by the LNG train or liquefaction facility.

36. The LNG production plant according to claim 35, wherein the at least one LNG storage facility is a plant module and the LNG storage facility is supported on an offshore support structure.

37. The LNG production plant according to claim 35, wherein the at least one LNG storage facility is a gravity-based structure or a floating structure.

* * * * *